US012392123B2

(12) United States Patent
Meier et al.

(10) Patent No.: US 12,392,123 B2
(45) Date of Patent: Aug. 19, 2025

(54) CHANNEL-RETAINING DEVICE, DRAINAGE SYSTEM AND METHOD

(71) Applicant: ACO AHLMANN SE & CO. KG, Büdelsdorf (DE)

(72) Inventors: Stephan Meier, Albersdorf (DE); Arne Meincke, Osdorf (DE); Marco Wandkowski, Kronshagen (DE)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 269 days.

(21) Appl. No.: 18/040,876

(22) PCT Filed: Aug. 27, 2020

(86) PCT No.: PCT/EP2020/074033
§ 371 (c)(1),
(2) Date: Feb. 7, 2023

(87) PCT Pub. No.: WO2022/042849
PCT Pub. Date: Mar. 3, 2022

(65) Prior Publication Data

US 2023/0287672 A1 Sep. 14, 2023

(51) Int. Cl.
*E03F 1/00* (2006.01)
*E03F 5/04* (2006.01)

(52) U.S. Cl.
CPC ..... *E03F 5/04* (2013.01); *E03F 1/002* (2013.01)

(58) Field of Classification Search
CPC ..... E01C 11/227; E03F 1/002; E03F 1/003; E03F 1/005; E03F 5/04; E03F 5/0401; E03F 3/046; E03F 2005/0415
See application file for complete search history.

(56) References Cited

U.S. PATENT DOCUMENTS 5,281,052 A 1/1994 Beamer
5,437,424 A * 8/1995 Netz, Sr. ..... F16L 3/00 405/184.4

(Continued)

FOREIGN PATENT DOCUMENTS

BE 1004820 A3 2/1993
DE 9411477 U1 11/1994

(Continued)

OTHER PUBLICATIONS

An Office Action issued in corresponding Russian Patent Application No. 2023105731/10(012422); Mailing Date: Sep. 28, 2023.

(Continued)

*Primary Examiner* — Benjamin F Fiorello
(74) *Attorney, Agent, or Firm* — Chrisman Gallo Tochtrop LLC

(57) ABSTRACT

According to different embodiments, a channel-retaining device (200) can comprise: a retaining holder (102), which has a first coupling region (102*k*) and a retaining region (102*a*) for retaining a drainage channel extending in a direction; a retaining socket (104), which has a second coupling region (104*k*); wherein the first coupling region (102*k*) and the second coupling region (104*k*) form, when joined together, a joint (106), which provides the retaining holder (102) and the retaining socket (104) with a rotational degree of freedom (111) relative to each other in the direction; a locking device (108), which is designed to block the rotational degree freedom (111) when the locking device is placed in a first state, so that the retaining holder (102) and the retaining socket (104) are locked to each other, and designed to release the rotational degree freedom (111) when the locking device is placed in a second state, so that the retaining holder (102) and the retaining socket (104) can be moved relative to each other.

17 Claims, 25 Drawing Sheets

(56) References Cited

U.S. PATENT DOCUMENTS

| | | | | |
|---|---|---|---|---|
| 5,522,675 | A * | 6/1996 | Gunter | E03F 3/046 24/336 |
| 5,538,361 | A * | 7/1996 | Beamer | E03F 3/046 249/11 |
| 5,735,637 | A | 4/1998 | Gunter | |
| 6,220,784 | B1 * | 4/2001 | Bricker | E03F 3/046 249/11 |
| 6,595,720 | B2 * | 7/2003 | Humphries | E03F 3/046 405/118 |
| 6,860,678 | B2 * | 3/2005 | Gunter | E03F 3/046 405/122 |
| 7,264,418 | B1 * | 9/2007 | Houck | E03F 3/046 405/47 |
| 8,475,079 | B2 * | 7/2013 | Humphries | E03F 3/046 249/11 |
| 8,708,603 | B2 * | 4/2014 | Kerkhoff | E03F 3/046 405/184.4 |
| 9,834,894 | B1 * | 12/2017 | Reed | E03F 5/0407 |
| 9,932,730 | B2 * | 4/2018 | Files, Jr. | E03F 5/06 |
| 10,047,512 | B2 | 8/2018 | Chromey et al. | |
| 2006/0013649 | A1 * | 1/2006 | Humphries | H02G 3/0608 404/3 |
| 2015/0308092 | A1 | 10/2015 | Chromey et al. | |
| 2016/0319530 | A1 * | 11/2016 | Files, Jr. | E03F 3/046 |
| 2017/0241121 | A1 * | 8/2017 | Files, Jr. | E01C 11/227 |

FOREIGN PATENT DOCUMENTS

| | | | |
|---|---|---|---|
| DE | 4429457 | A1 | 3/1995 |
| DE | 29619267 | U1 | 12/1996 |
| DE | 20005651 | U1 | 6/2000 |
| DE | 20302899 | I1 | 1/2004 |
| EP | 1195476 | A2 | 4/2002 |

OTHER PUBLICATIONS

The International Search Report issued in corresponding International PCT Application No. PCT/EP2020/074033; Mailing Date: Jun. 22, 2021.

* cited by examiner

CHANNEL-RETAINING DEVICE, DRAINAGE SYSTEM AND METHOD

Various exemplary embodiments relate to a channel-retaining device, a drainage system, and a method.

Drainage systems are conventionally used for drainage, e.g. for surface drainage. Although one-piece drainage channels can be laid quickly and with little effort, they are limited in the application scenarios that they serve, since they require particularly good terrain conditions and structurally weaken the subsoil. Therefore, a vertical functional separation is increasingly being used, so that the components close to the surface for water absorption are separate from the components for water transport, which require more installation space. On the one hand, this functional separation reduces the structural weakening of the subsoil and, on the other hand, facilitates the leveling of the terrain.

However, this also involves a larger number of components, which complicates the specific configuration of the surface drainage. Therefore, temporary frames are conventionally produced to hold the drainage system to be buried in position while it is being buried.

According to various embodiments, it was clearly recognized that these temporary frames are very time-consuming to produce; furthermore, they also require special (clearly well-versed and experienced) specialists and are limited in their accuracy and ability to align and can hardly be corrected afterwards. In particular, it is complex to achieve precise alignment of the components close to the surface in the three main axes. For example, suitable specialists are not always available, so that compromises have to be accepted in the precision and thus the performance of the drainage system.

According to various embodiments, a channel-retaining device, a drainage system, and a method are provided which make it possible to dispense with temporary frames or at least to require fewer temporary frames. According to various embodiments, the channel-retaining device provides a cost-effective and less complex mechanism for leveling the terrain, which clearly enables the most precise possible alignment (a height and/or position alignment) with little effort and also improves the overall quality of the drainage system. For example, the channel-retaining device makes it easier to compensate for uneven ground, to drain against the incline of the terrain, to form a sloping channel, and/or to bury the collecting pipe so deep that it experiences as little removal load as possible. The components close to the surface can clearly be aligned with the desired course of the surface to be drained, while the components for water removal are aligned in an optimal gradient, which does not necessarily have to extend parallel to the surface to be drained.

In the drawings,

FIG. 1 shows a drainage system according to various embodiments in a schematic side view or cross-sectional view;

FIGS. 2 to 5, FIG. 8, and FIG. 10 each show a channel-retaining device according to various embodiments in different schematic views;

Figure 9:
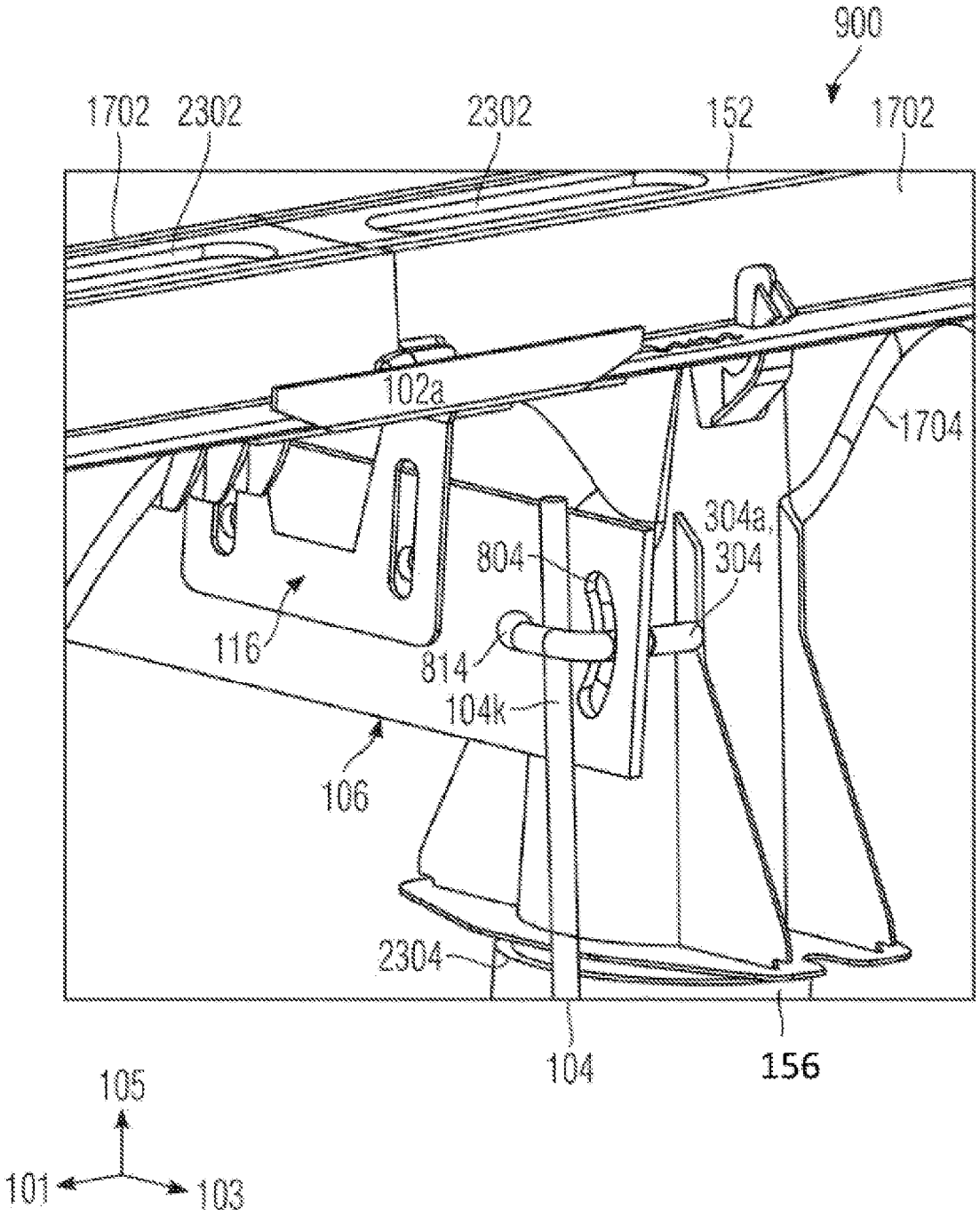
Figure 11:
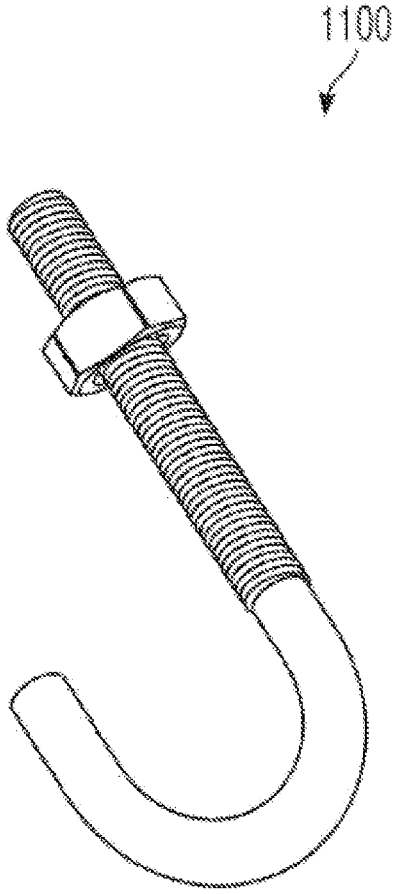
Figure 12:
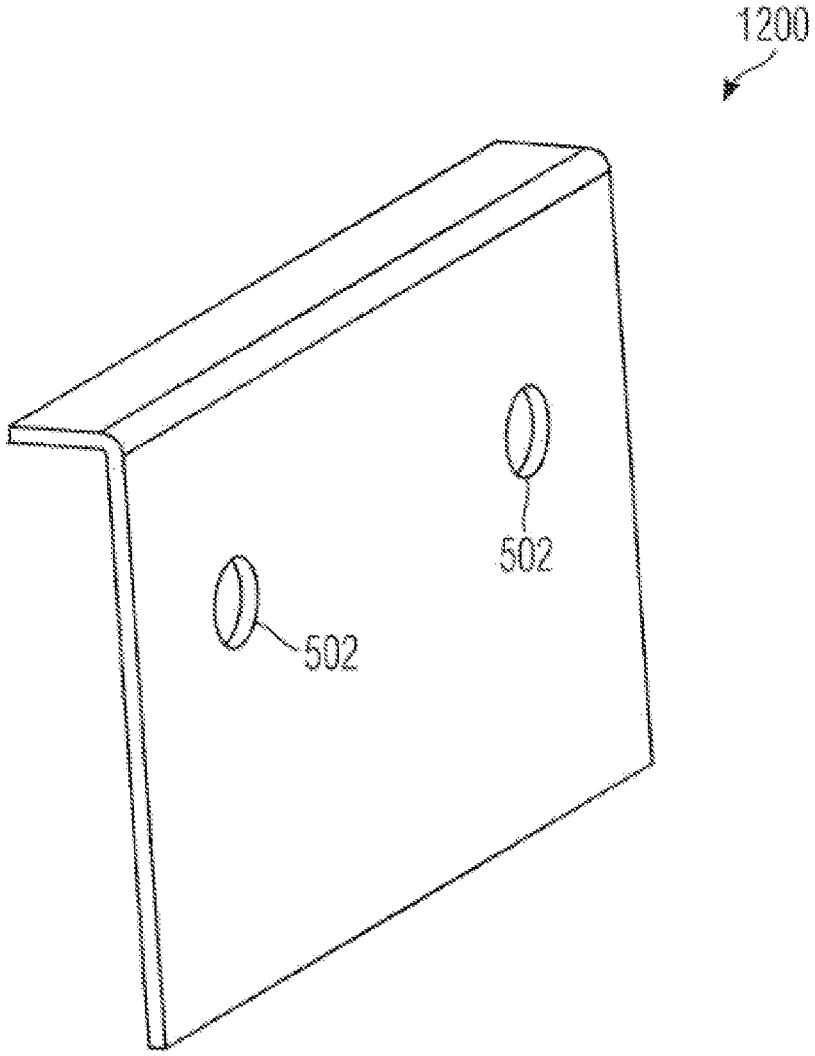
Figure 13:
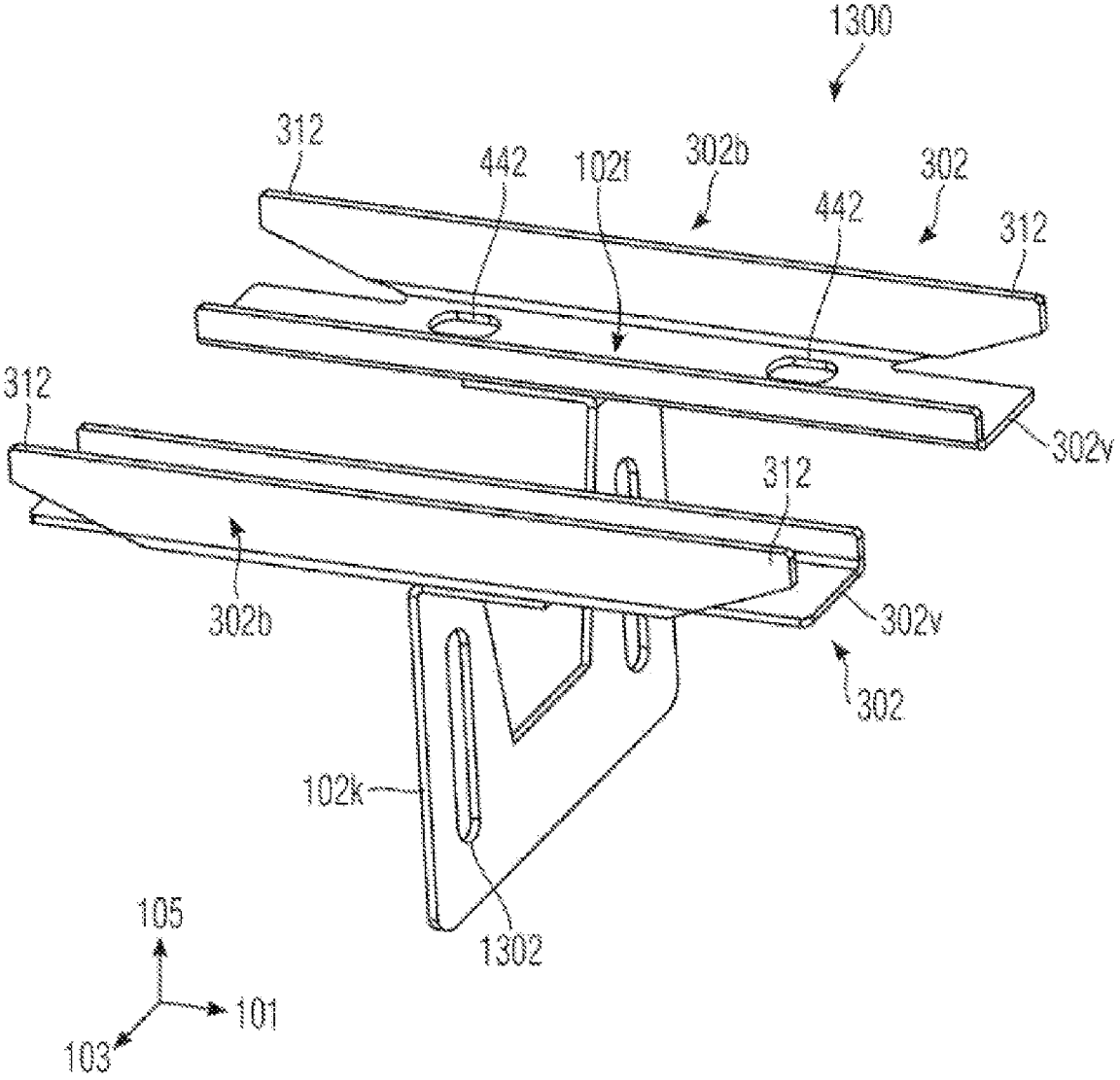
Figure 14:
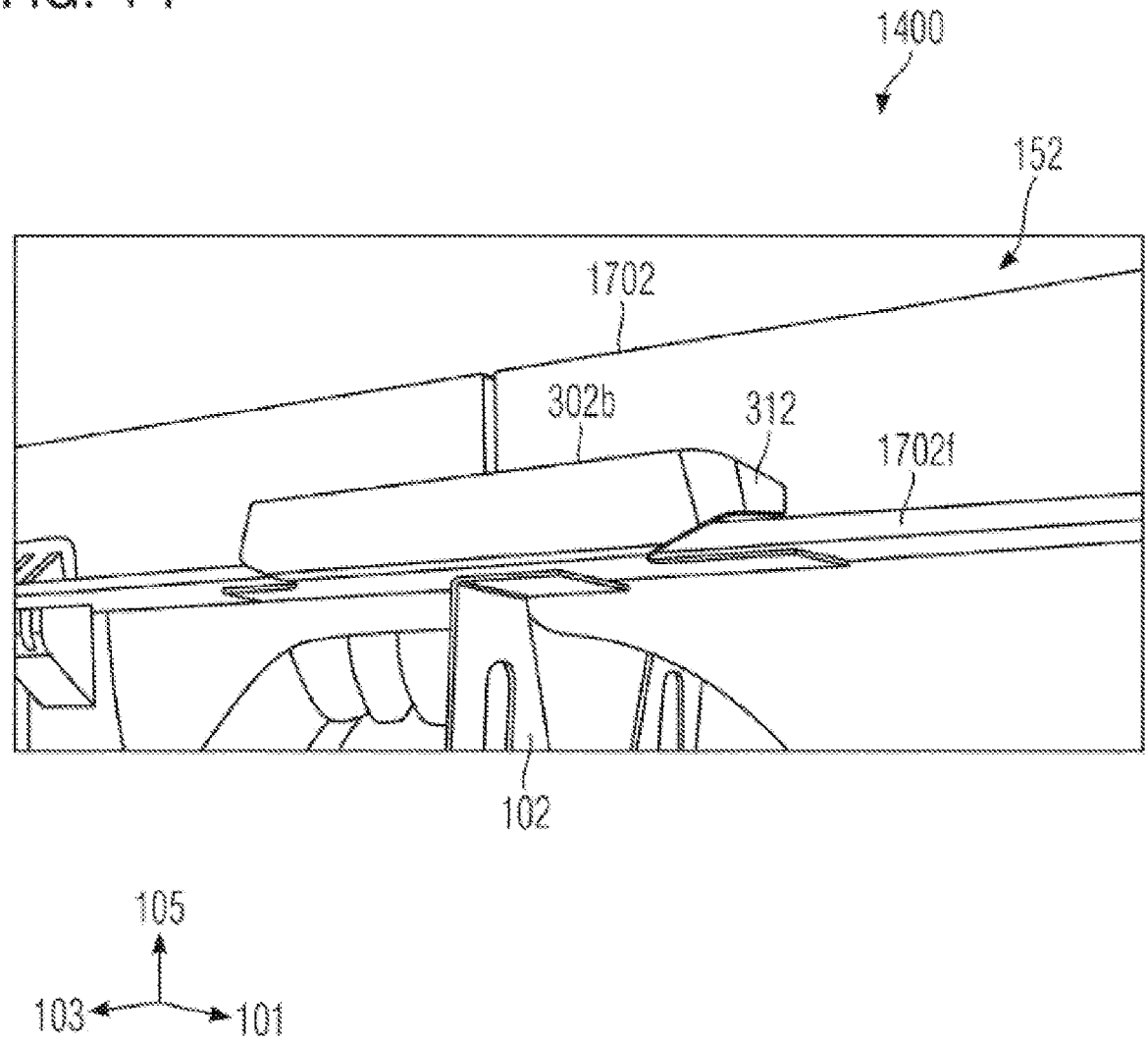
Figure 15:
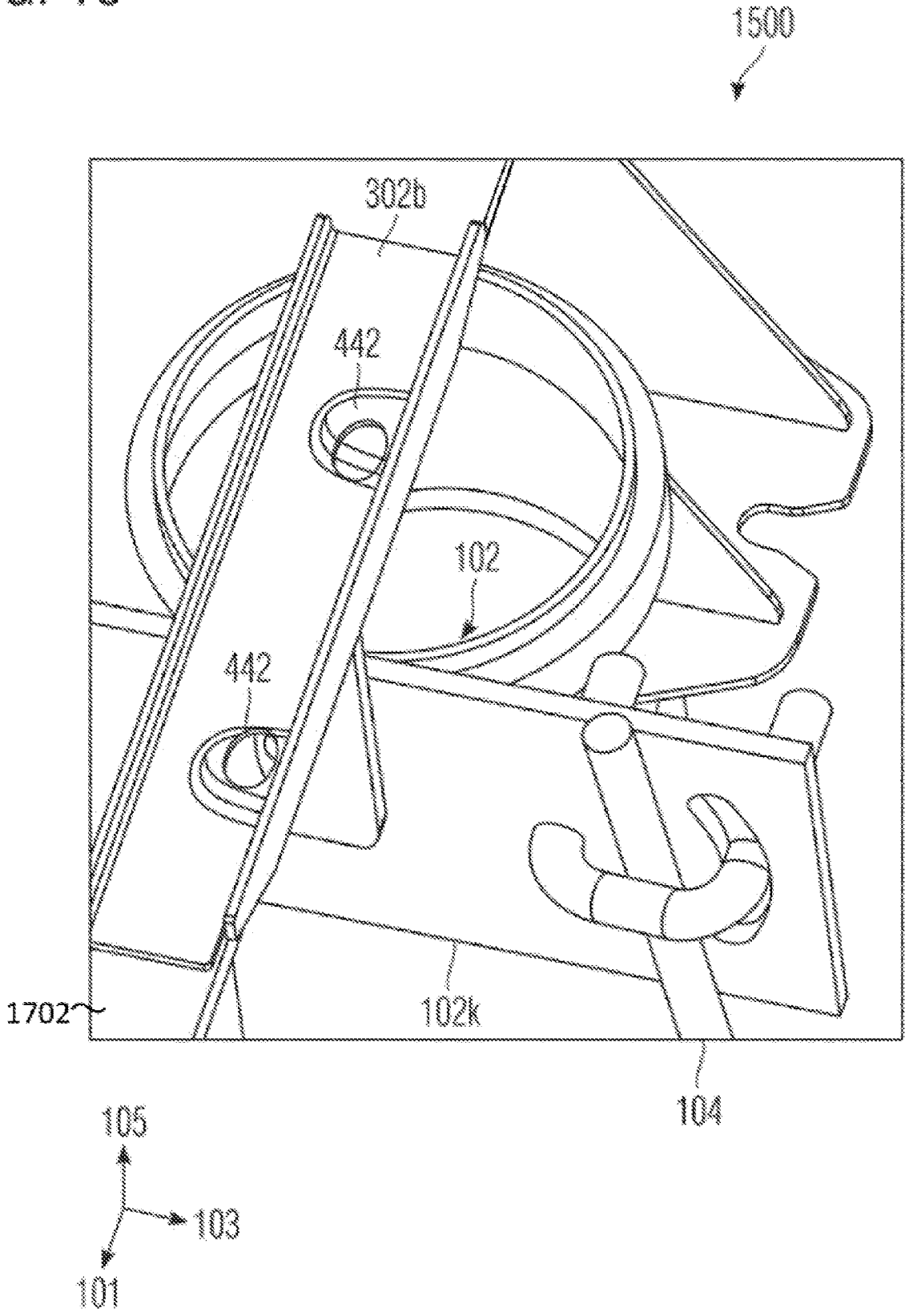
Figure 16:
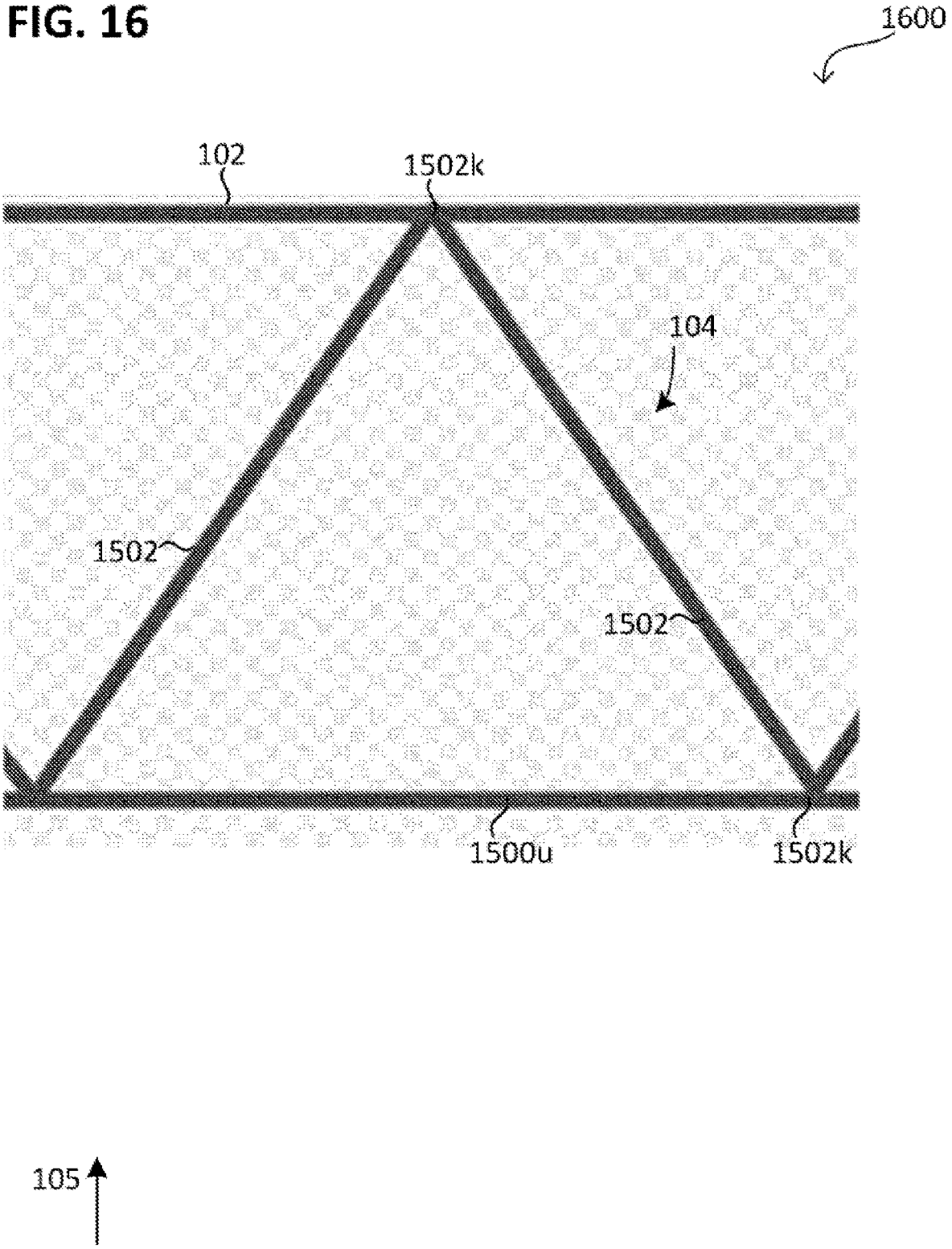
Figure 17:
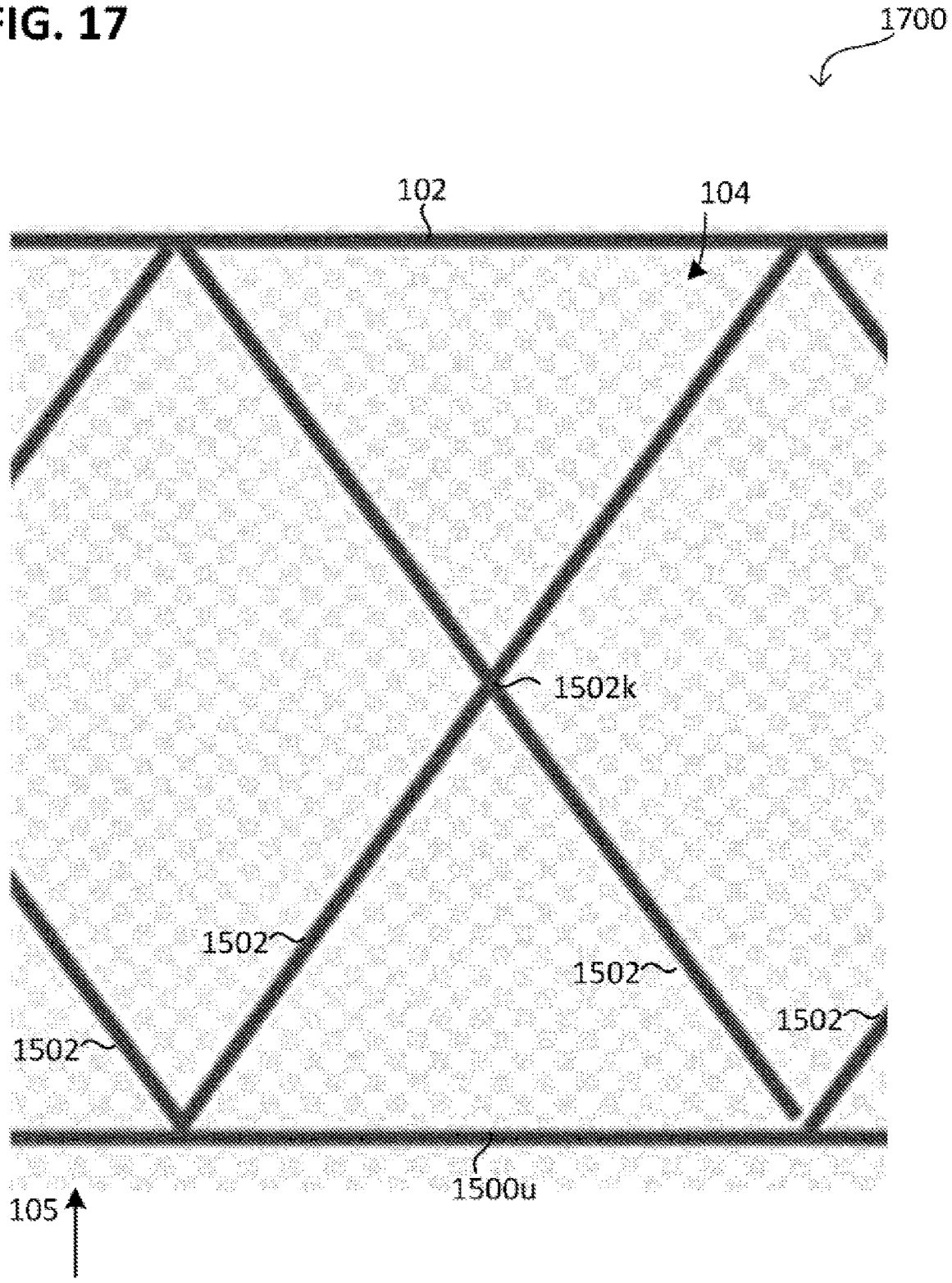
Figure 21:
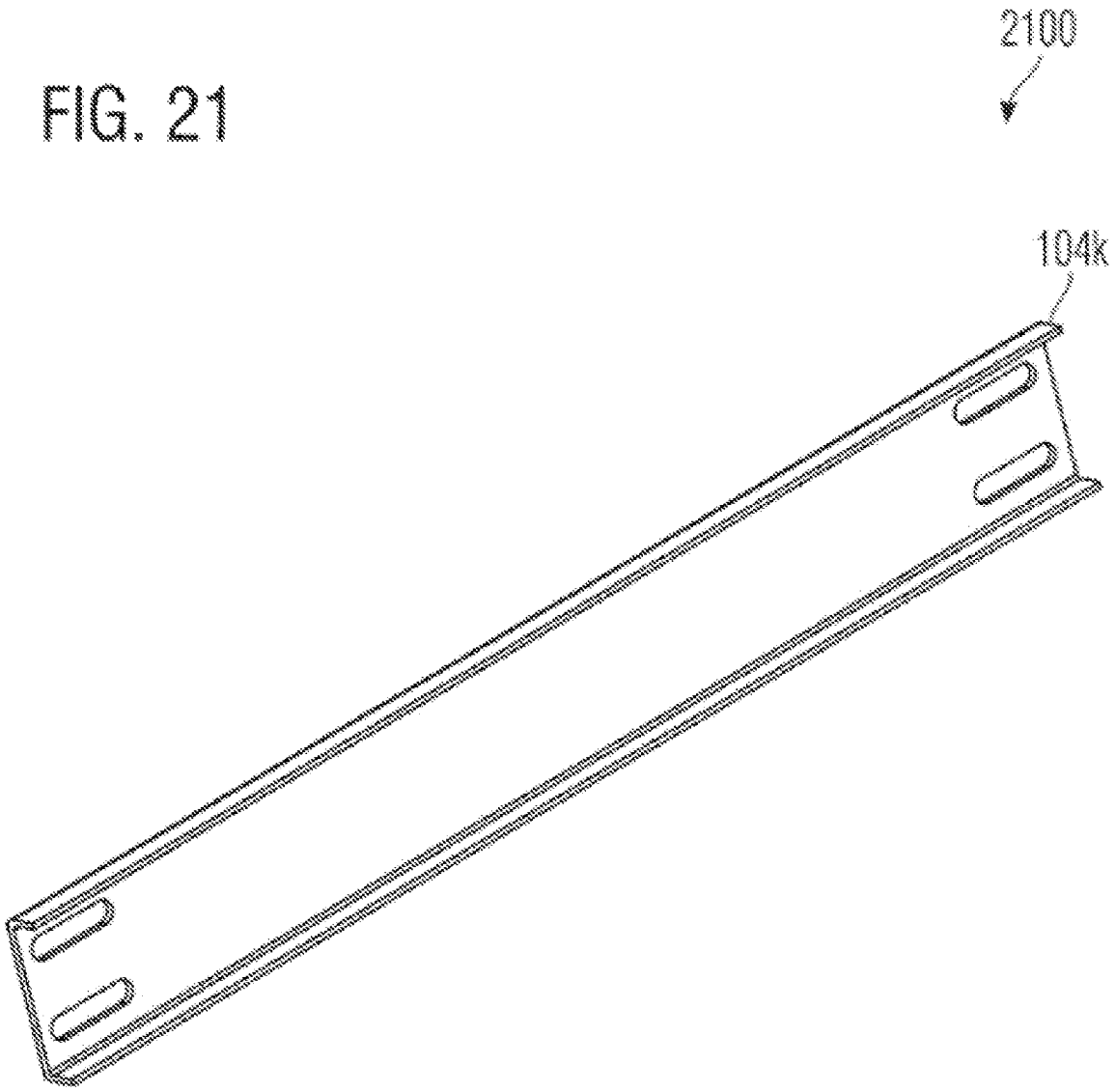
Figure 22:
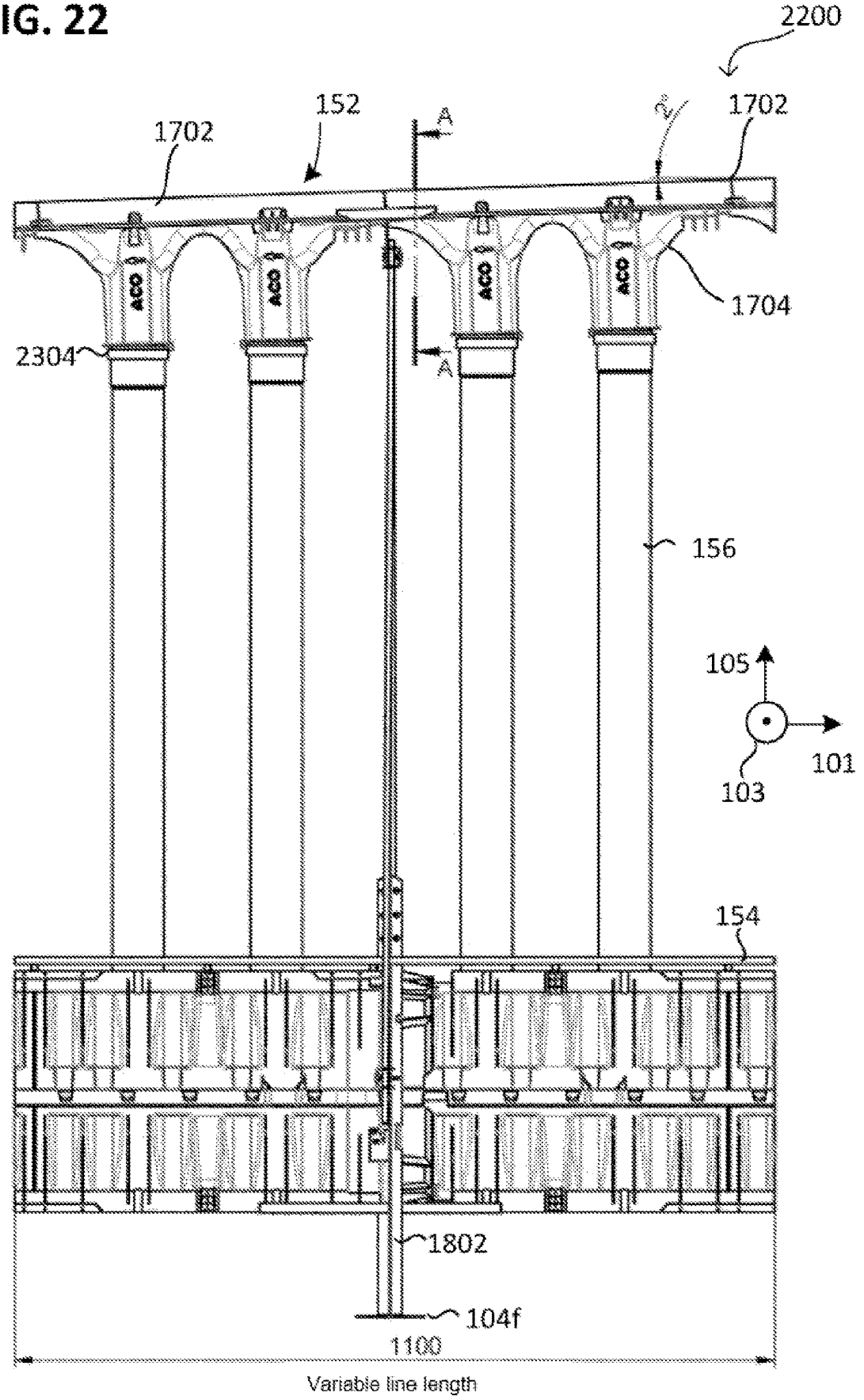
Figure 23:
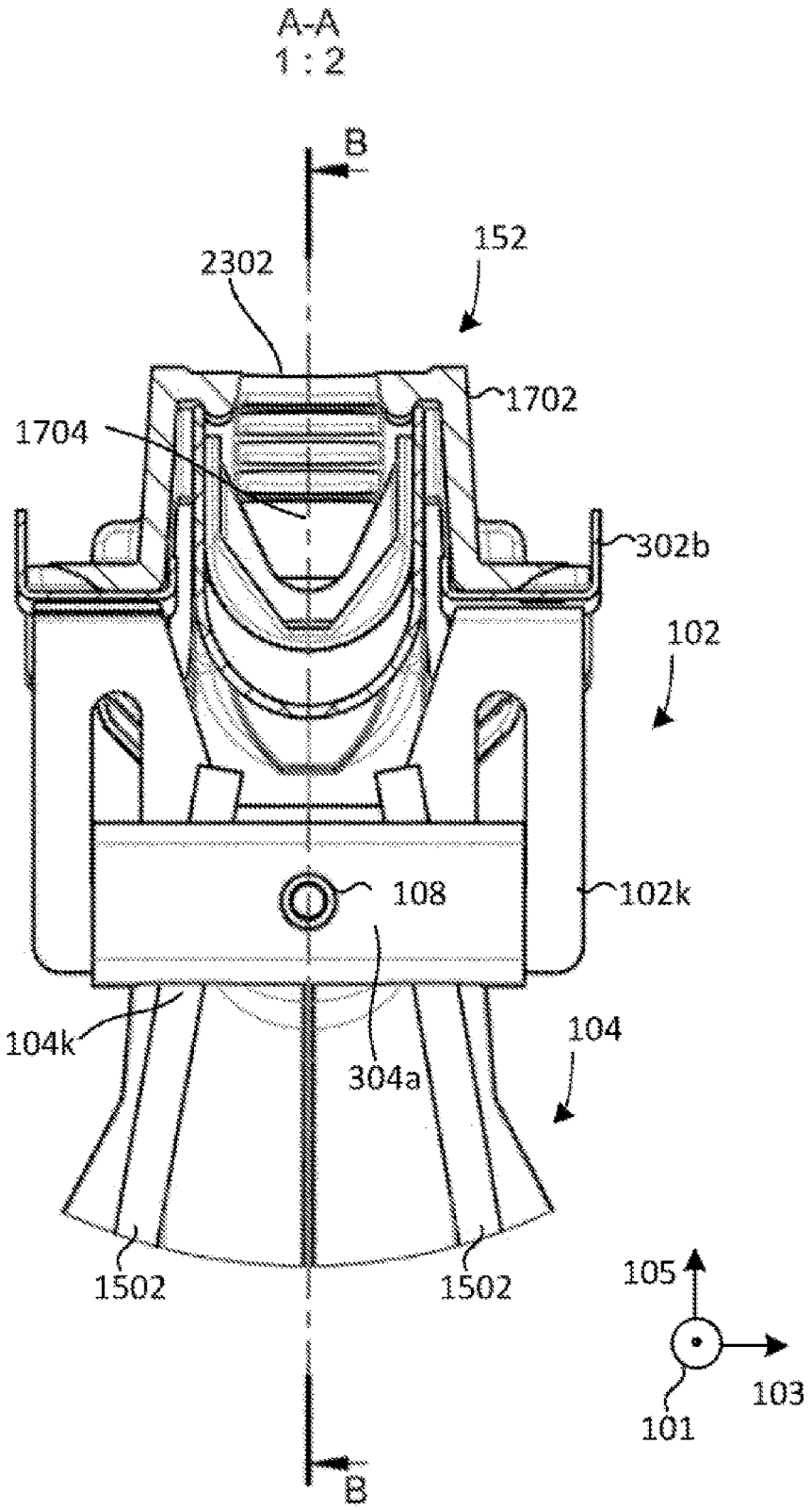
Figure 24:
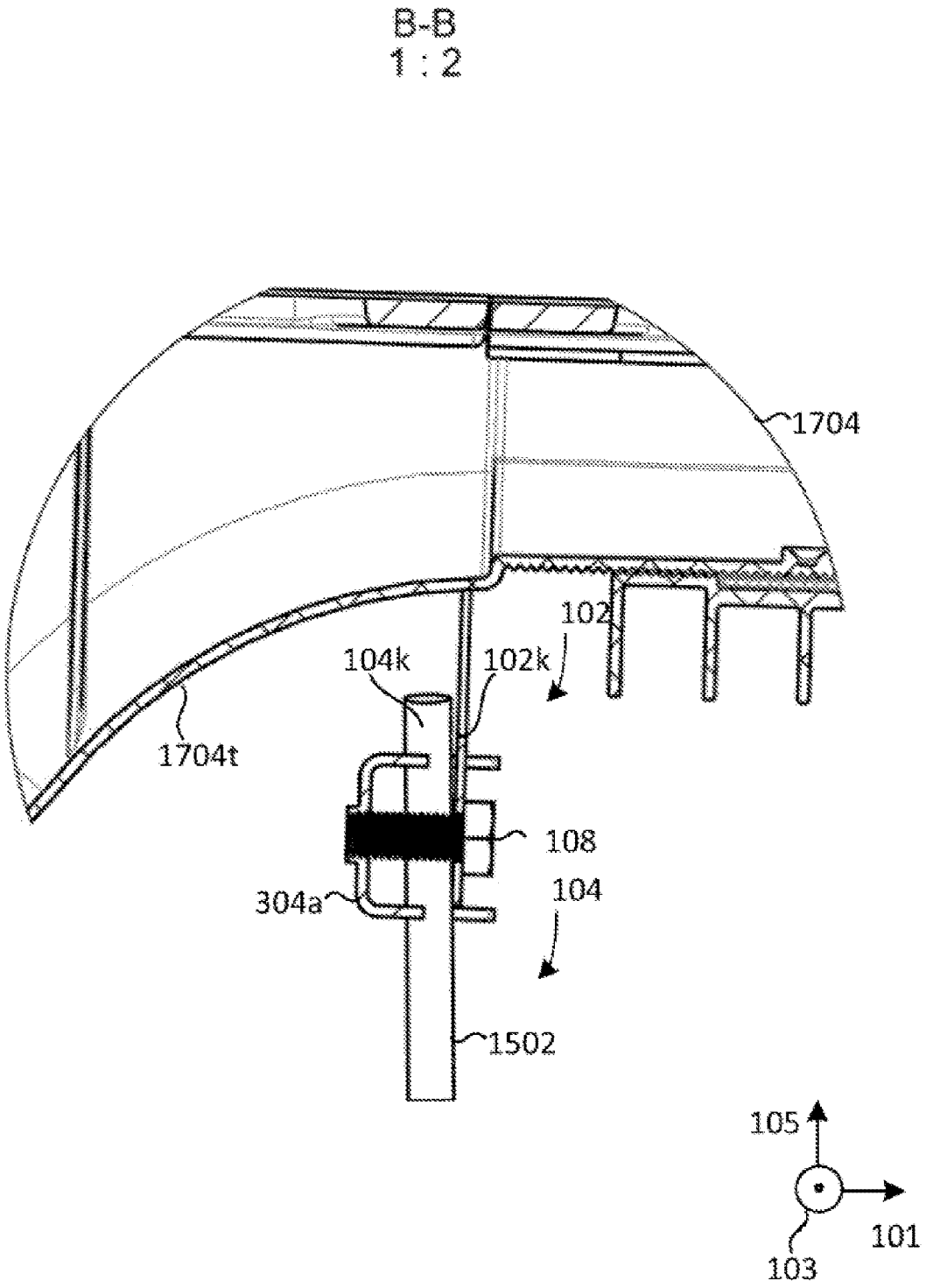

FIG. 9, FIG. 14, and FIG. 15 each show a drainage system according to various embodiments in various schematic views;

FIG. 11 shows a hook bolt according to various embodiments in a schematic perspective view;

FIG. 12 shows a clamping plate according to various embodiments in a schematic perspective view;

FIG. 13 shows a retaining holder according to various embodiments in a schematic perspective view;

FIG. 16 and FIG. 17 each show a channel-retaining device according to various embodiments in a schematic side view or cross-sectional view;

FIG. 18 to FIG. 20 and FIG. 25 each show a drainage system according to various embodiments in a schematic perspective view;

FIG. 21 shows a spacer plate according to various embodiments in a schematic perspective view; and FIG. 22 to FIG. 24 each show an assembly of the drainage system according to various embodiments in various schematic views.

In the following detailed description, reference is made to the accompanying drawings that form a part thereof and in which specific embodiments are shown for illustration in which the invention may be practiced. In this regard, directional terminology such as "top," "bottom," "front," "back," "front," "rear," etc. is used with reference to the orientation of the figure(s) being described. Because components of embodiments can be positioned in a number of different orientations, the directional terminology is used for purposes of illustration and is in no way limiting. It is understood that other embodiments may be utilized and structural or logical changes may be made without departing from the protective scope of the present invention. It is understood that the features of the various exemplary embodiments described herein can be combined with one another unless specifically stated otherwise. The following detailed description is, therefore, not to be taken in a limiting sense, and the protective scope of the present invention is defined by the appended claims.

Throughout this description, the terms "connected," "attached," and "coupled" are used to describe both a direct and an indirect connection, a direct or indirect attachment, and a direct or indirect coupling. In the figures, identical or similar elements are provided with identical reference symbols, insofar as this is appropriate. According to various embodiments, the term "coupled" or "coupling" can be understood in the sense of a (e.g. mechanical and/or hydrostatic), e.g. direct or indirect, connection and/or interaction. For example, several elements can be coupled to one another along an interaction chain, along which the e.g. mechanical and/or hydrostatic interaction can be exchanged, e.g. a fluid (then also referred to as coupled in a fluid-conducting manner) or a force. According to various embodiments, "coupled" can be understood in the sense of a mechanical (e.g. physical) coupling, e.g. by means of direct physical contact. A coupling can be configured to transmit a mechanical interaction (e.g. force, torque, etc.).

In the context of this description, the expression "at least one" is used in connection with an element (e.g. an object, a process, a body) to describe a quantity of the element, which can be exactly one or more than one. Accordingly, the at least one element can be understood as comprising one or more than one element, e.g. comprising several (e.g. two or more, three or more, etc.) elements.

Within the scope of this description, the term "degree of freedom" is used in connection with a body or a system to describe a possibility of movement of the body or the system. Several degrees of freedom can designate possibilities of movement that are independent of one another, i.e. they correspond to axes that are perpendicular to one another. Basically, a degree of freedom can be either a translational degree of freedom or a rotational degree of freedom. Each degree of freedom can correspond to an axis to which the possibility of movement is related. For example, the translational degree of freedom may allow linear movement (i.e. translation) along the axis. For example, the rotational degree of freedom may allow rotational movement (i.e. rotation) about the axis. A fully free body has six degrees of freedom, namely three translational degrees of freedom and three rotational degrees of freedom. If a degree of freedom is blocked, there is no possibility of movement according to the corresponding axis. At least one degree of freedom can be blocked, for example, by creating a force fit, a form fit, or a material bond.

According to various embodiments, a joint provides a flexible coupling between two rigid bodies, i.e. a coupling that leaves at least one degree of freedom open. The respective mobility of a joint can be provided by means of at least one degree of freedom of the form of movement taking place therein, e.g. rotating in the case of a pivot joint and/or translation in the case of a sliding joint. The joint provides that the two bodies remain coupled to each other when moving relative to each other, i.e. they do not disengage from each other. The joint-forming regions (e.g. bore and bolt) of the two bodies that are geometrically designed to match one another are referred to as coupling regions. The joint-forming regions can be coupled to one another, for example, in that they form a form fit. The relative movement between the two bodies can, for example, take place in a sliding and/or rolling manner. The joint can be configured to transmit forces and/or torques acting at least along at least one axis between the two connected bodies.

In the context of this description, the term "drainage" is used in connection with "water" or "drainage." It can be understood that this description can apply by analogy to other liquids that are not necessarily water or need to include water. For example, the drainage system described herein can be generally suitable for draining fluids of various types and compositions, e.g. liquids, flowable mixtures, or the like.

The channel-retaining device described herein can clearly be used as a support for a drainage channel. Various channel-retaining implementations are discussed herein, of which one has a simplified implementation that the channel-retaining device has support pillars supported on the ground or formwork, and of which one has a more complex implementation that the channel-retaining device has at least one pipe-retaining device supporting the bottom collecting pipe and the support pillars. The simplified implementation can be implemented especially cost-effectively. The more complex implementation, on the other hand, achieves greater precision.

According to various embodiments, the channel-retaining device has a retaining socket that is configured to be inserted into subsoil, mounted upright on the subsoil, or attached to formwork. Exemplary components of the retaining socket have: one or more struts, such as one or more rebars (also referred to as reinforcing bars), one or more shaped profiles, one or more tension and/or compression bars, one or more sheets, such as one or more spacer plates, one or more channel-retaining plates. For example, the drainage system can be arranged and installed in an excavation pit that has already been boarded up. In this case, the retaining socket (e.g. its struts) can be attached directly to the formwork, which facilitates assembly. If necessary, the struts can be bent and/or shortened to the desired position.

According to various embodiments, the channel-retaining device has at least one retaining holder, which has at least one coupling region (also referred to as the first coupling region) for coupling the retaining socket. Exemplary components of the retaining holder have: at least one recess, at least one sheet, at least one rail, at least one holder, and at least one joining device for the drainage channel.

According to various embodiments, at least one of the following is provided by means of the channel-retaining device: that a stepless alignment and/or height adjustment of an inlet molding device takes place, which is supported, for example, by means of reinforcing bars; that the channel-retaining device provides a joint for laterally tilting the inlet molding device; that the channel-retaining device can be retrofitted to the inlet molding device; that a truss is provided by means of the supporting struts; and that spacer plates can be used as an alternative to the struts (e.g. reinforcing bars).

Figure 1:
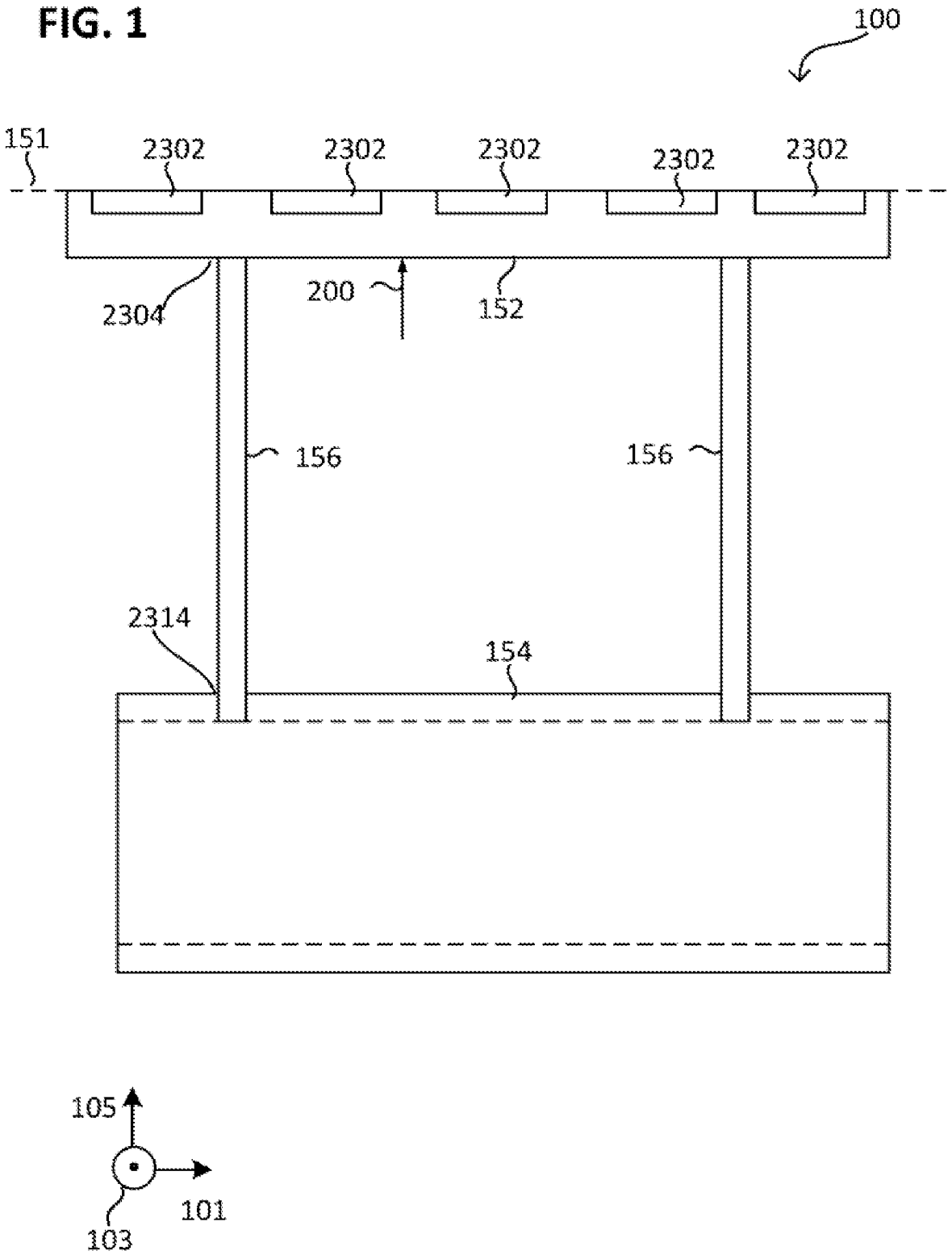

FIG. 1 shows a drainage system 100 according to various embodiments in a schematic side view or cross-sectional view; According to various embodiments, the drainage system 100 can have a drainage inlet device 152 (also referred to simply as an inlet device or inlet molding device), optionally have a collecting line 154 (also referred to as a water removal line or collecting fluid line), and optionally have at least one drop line 156. The or each collecting line 154 can be or can be provided, for example, by means of at least one collecting pipe 154 (also referred to as a water removal pipe). The or each drop line 156 can be provided, for example, by means of at least one downpipe 156.

In principle, however, the drainage system 100 does not necessarily have to have the at least one collecting pipe 154 or downpipe 156 as a separate component (e.g. plastic pipe, concrete pipe, wooden pipe, sheet metal pipe) in order to provide the corresponding lines. For example, the embedding material can have cavities formed in some other way (e.g. natural or artificial), which provide at least one collecting line 154 and/or at least one drop line 156 or to which the liquid taken up by the drainage inlet device 152 can be fed. To put it more clearly, the collecting line 154 or drop line 156 can also be provided as a monolithic component of the embedding material. In order to form such fluid-conducting cavities in the embedding material, a displacement body (e.g. polystyrene) can be introduced into the embedding material, for example, which is removed (e.g. thermally decomposed) when the embedding material has hardened. Instead of the displacement body, the cavity of the downpipe 156 or the collecting pipe 154 then remains.

In the following, for ease of understanding, reference is made to the collecting pipe 154 and downpipe 156 as exemplary lines. What has been described for the collecting pipe 154 can also apply analogously to any collecting line 154 provided differently, or what has been described for the downpipe 156 can also apply analogously to any drop line 156 provided differently.

The drainage system 100, for example its drainage inlet device 152 and/or its collecting pipe 154, can be longitudinally extended along direction 101 (for example, the direction of flow of the drainage channel or the collecting pipe). When the drainage system 100 is installed, planetary gravity can act on the drainage system 100 from direction 105.

For example, direction 105 can then be essentially parallel to the vertical (i.e. with a maximum deviation of 10°). When the drainage system 100 is assembled, each downpipe 156 can be longitudinally extended along direction 105.

The collecting pipe 154 may have one or more than one pipe section. For example, the collecting pipe 154 can be in several parts. The multi-part collecting pipe 154 can have several pipe segments, which are arranged one behind the other along direction 101 and joined together so that they form a common cavity.

The drainage inlet device 152 can have at least one drainage channel or be formed therefrom. Optionally, the drainage inlet device 152 can be composed of several parts. The multi-part drainage inlet device 152 can have, for example, a multi-part drainage channel and/or an enclosure device (also referred to as a frame). The drainage channel can, for example, have a plastic or be formed therefrom, which reduces its production costs.

The frame can, for example, laterally enclose the (e.g. multi-part) drainage channel. The frame can have a groove, for example, in which the drainage channel is arranged. The frame can, for example, have or be formed from a metal (e.g. steel), which increases stability. For example, the frame can be a cast product (then also referred to as a cast frame).

Furthermore, the drainage inlet device 152 (e.g. its frame) can have several openings 2302 (also referred to as inlet openings) arranged one behind the other along direction 101, of which each opening optionally extends longitudinally along direction 101 (then also referred to as a longitudinal slot). This improves the water absorption rate.

The multi-part drainage channel can have several channel segments, which are arranged one behind the other along direction 101 and are joined together, for example, by means of the frame. Optionally, each channel section can be funnel-shaped.

Each downpipe 156 may be positioned between the drainage inlet device 152 and the collecting pipe 154. Each downpipe 156 may fluidly couple the drainage inlet device 152 (e.g. its drainage channel) to the collecting pipe 154. For this purpose, the drainage inlet device 152, e.g. its drainage channel (e.g. each channel section), can have an opening 2304 (also referred to as an upper drop opening 2304) which is coupled to a downpipe 156. By analogy, the collecting pipe (e.g. each pipe section) may have an opening 2314 (also referred to as a lower drop opening 2314) which is coupled to a downpipe 156 or through which the downpipe 156 protrudes into the collecting pipe 154.

Optionally, the collecting pipe 154 may include a seal (e.g. an O-ring) surrounding the drop opening of the collecting pipe 154. This means that the downpipe 156 can be inserted into the drop opening of the collecting pipe 154 so that the height of the latter can be adjusted. Optionally, the collecting pipe 154 can have one hold-down device (e.g. a seal hold-down plate), which surrounds the downpipe 156, per drop opening. The drop opening can be covered in direction 105 and/or the seal can be held in position by means of the hold-down device. The connection between the hold-down device and the collecting pipe 154 can be made, for example, by means of screws.

When the drainage system 100 is assembled, the drainage inlet device 152 may be exposed at the drainage surface 151. This means that liquid on the surface 151 is taken up by the drainage inlet device 152. The collected liquid is routed to the downpipes, which routes the liquid to the collecting pipe 154, by means of the drainage inlet device 152.

When the drainage system 100 is assembled, the collecting pipe 154 and the at least one downpipe 156 (if present) can be arranged below a surface 151 to be drained (also referred to as the drainage surface 151). The drainage surface 151 may be, for example, the surface of a structurally sealed surface, such as an asphalt layer or a concrete layer. For example, the collecting pipe 154 and the at least one downpipe 156 can be arranged below the drainage surface 151, e.g. embedded in a material (also referred to as embedding material). Examples of the embedding material include: earth, gravel, sand, concrete, or asphalt.

In order to facilitate the assembly of the drainage system 100, the drainage channel can be retained, for example supported from below, by means of a channel-retaining device 200 according to various embodiments. The inlet openings 2302 can be arranged, for example, on a side of the drainage inlet device 152 that faces away from the channel-retaining device 200.

A method of assembling the drainage system 100 may include aligning the drainage inlet device 152 (e.g. its drainage channel) being retained by the channel-retaining device 200. During alignment, the channel-retaining device 200 may be in an unlocked state. In the unlocked state, the channel-retaining device 200 may provide the drainage inlet device 152 with one or more degrees of freedom (e.g. rotational degrees of freedom and/or translational degrees of freedom).

Once the alignment is complete, the channel-retaining device 200 can be placed in a locked state (also referred to as locking). For example, the locking may include reducing, e.g. to zero, the number of degrees of freedom provided to the drainage inlet device 152 by means of the channel-retaining device 200. In the locked state, the at least one degree of freedom can be blocked.

The channel-retaining device 200 can be placed in the locked state or in the unlocked state by means of a locking device, as will be described later in more detail.

Figure 2:
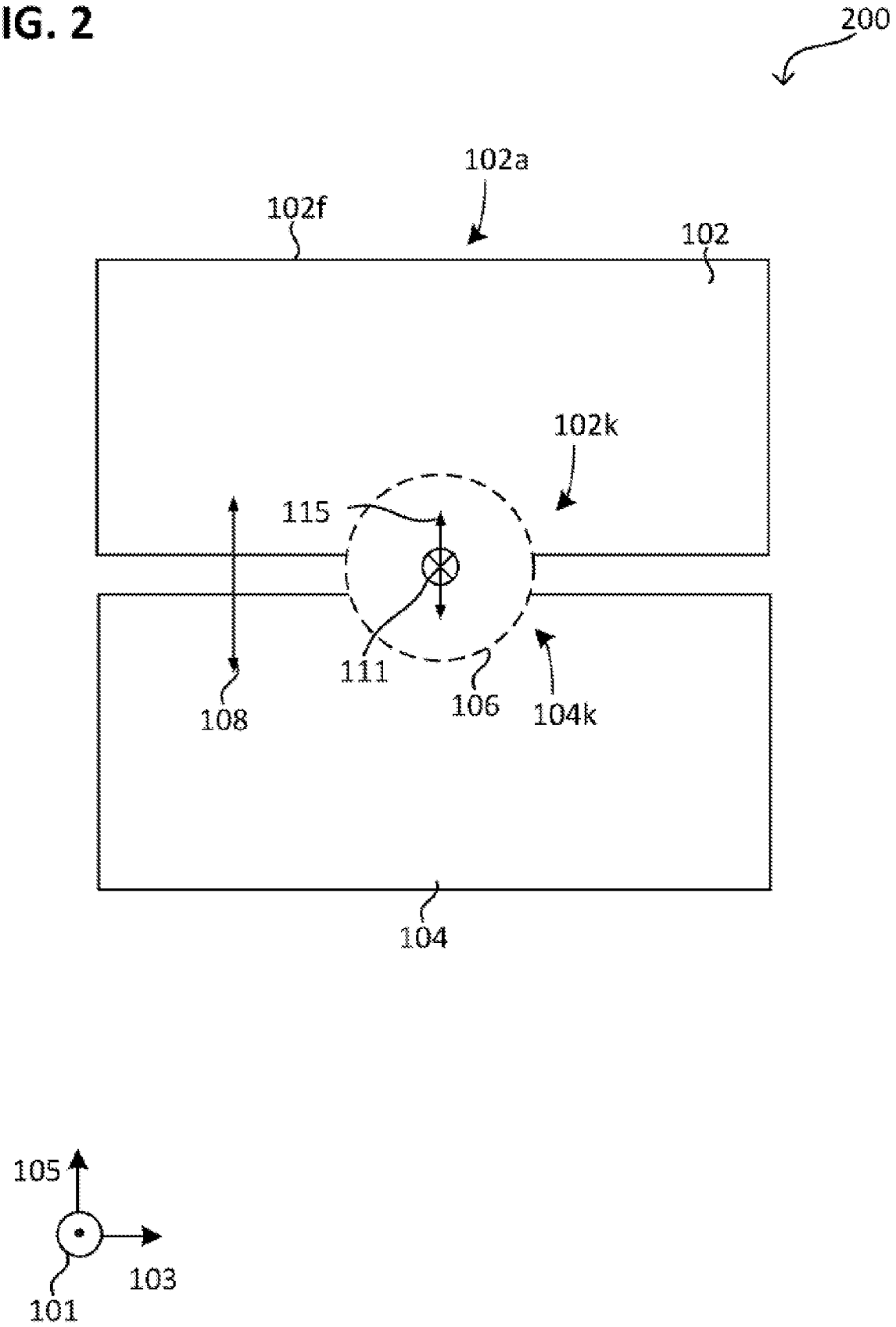

FIG. 2 shows a channel-retaining device 200 according to various embodiments in a schematic side view or cross-sectional view. The channel-retaining device 200 can have a retaining holder 102 and a retaining socket 104. The retaining holder 102 can have a first coupling region **102*k*. The retaining socket 104 can have a second coupling region 104*k***.

The retaining holder 102 and/or the retaining socket 104 can, for example, have or be formed from a metal (e.g. steel), which increases stability.

The first coupling region **102*k* and the second coupling region 104*k* can be configured relative to one another in such a way that they are or can be joined together. The coupling between the first coupling region 102*k* and the second coupling region 104*k* can be formed by plugging, screwing, or clamping, for example. However, the first coupling region 102*k* and the second coupling region 104*k*** do not necessarily have to be pre-assembled. For example, they can also be joined together when the drainage system is installed, for example shortly before a drainage channel is aligned.

The joining together can include the first coupling region **102*k* and the second coupling region 104*k* being coupled (or connected) to one another, for example by means of a form fit and/or by means of a connecting element. The cohesion between the first coupling region and the second coupling region is created or increased by means of the joining together. The coupling can be movable, so that the first coupling region 102*k* and the second coupling region 104*k* form a joint 106** when joined together. The operating forces that occur are transferred via the active surfaces of the connection, and at least one degree of freedom is provided.

The coupling between the first coupling region **102*k* and the second coupling region 104*k* can be detachable, non-detachable, or conditionally detachable. The non-detachable coupling can, for example, have a material bond, e.g. a welded connection. The non-detachable coupling is, for example, irreversible in such a way that it can only be released by destroying the first coupling region 102*k* and/or the second coupling region 104*k*. The detachable coupling can, for example, have a screw connection. The detachable coupling can, for example, be reversibly detached and established, for example, without any significant impairment to the components involved in the coupling. The conditionally detachable coupling can, for example, have a rivet connection or a soldered connection. The conditionally detachable coupling is, for example, irreversible in such a way that it can be released by destroying a coupling component (e.g. the rivets) but without destroying the first coupling region 102***k* and/or the second coupling region 104*k*.

The joint 106 can provide the retaining holder 102 and the retaining socket 104 with at least one (i.e. one or more than one) degree of freedom 111, 115 relative to one another. The at least one degree of freedom 111, 115 can have one or more than one rotational degrees of freedom (also referred to as a rotation degree of freedom) and/or one or more than one translational degrees of freedom (also referred to as a translation degree of freedom).

The at least one degree of freedom can have at least one rotational degree of freedom 111, for example, which is along direction 101. The rotational degree of freedom 111 provides that the retaining holder 102 and the retaining socket 104 can be rotated relative to one another about an axis of rotation, which is along the rotational degree of freedom 111. This means that a drainage channel held by means of the channel-retaining device 200 can be tilted laterally so that its spatial position can be adjusted (also referred to as alignment).

The at least one degree of freedom can have at least one translational degree of freedom 115, for example, which is along direction 105. The translational degree of freedom 115 provides that the retaining holder 102 and the retaining socket 104 can be displaced towards or away from one another along a translational axis, which is along the translational degree of freedom 115. This means that a drainage channel held by means of the channel-retaining device 200 can be displaced vertically so that its spatial position can be adjusted (also referred to as alignment).

The retaining holder 102 can also have a retaining region 102*a* for supporting the drainage channel extending along direction 101. The retaining region 102*a* can, for example, be opposite the first coupling region 102*k*.

In principle, the retaining region 102*a* can be adapted to the shape of the drainage channel. For example, the retaining region 102*a* can have a bearing surface which faces away from the first coupling region 102*k*. The bearing surface can be curved, angled, or planar, for example, or have mixed forms of these.

For example, the retaining holder (and its retaining region 102*a*) can be a component separate from the drainage channel, which component can optionally be or become connected to the drainage channel. As an alternative or in addition, the retaining holder (and its retaining region 102*a*) can be connected to the drainage channel or a component (e.g. the frame) of the drainage channel by a material bond.

The channel-retaining device 200 can also have a locking device 108 which is configured to be placed in a first state or into a second state. When placed in the first state, the locking device 108 can block the at least one degree of freedom 111, 115 so that the retaining holder 102 and the retaining socket 104 are locked together. The channel-retaining device 200 is then in the locked state.

When placed in the second state, the locking device 108 can release the at least one degree of freedom so that the retaining holder 102 and the retaining socket 104 are movable relative to each other. The channel-retaining device 200 is then in the unlocked state.

For example, the locking device 108 can be configured to lock the retaining holder 102 and the retaining socket 104 to one another by means of a form fit, a force fit, and/or a material bond. The force fit can be established, for example, by means of a thread on the locking device 108. The form fit can be established, for example, by means of a bolt on the locking device 108. The material bond can be established, for example, by means of welding the locking device 108.

Exemplary components of the locking device 108 have: at least one rivet, at least one bolt, at least one screw, at least one nut, at least one lever, at least one thread, at least one locking lug.

Optionally, the retaining holder 102 and/or the retaining socket 104 can be in multiple parts, as will be described later in more detail.

Alignment of the drainage inlet device 152 (e.g. its drainage channel), which is held by means of the retaining holder 102 of the channel-retaining device 200, can include moving the retaining holder 102 and the retaining socket 104 relative to one another according to the at least one degree of freedom 111, 115 (e.g. rotational degree of freedom). In this way, their position (position and/or orientation) can be changed relative to one another. Once the alignment of the drainage inlet device 152 is complete, the channel-retaining device 200 can be locked. The locking can include transitioning the locking device 108 into the first state so that the retaining holder 102 and the retaining socket 104 are locked together. In the first state, the locking device 108 can be configured to be detachable, non-detachable, or conditionally detachable.

Figure 3:
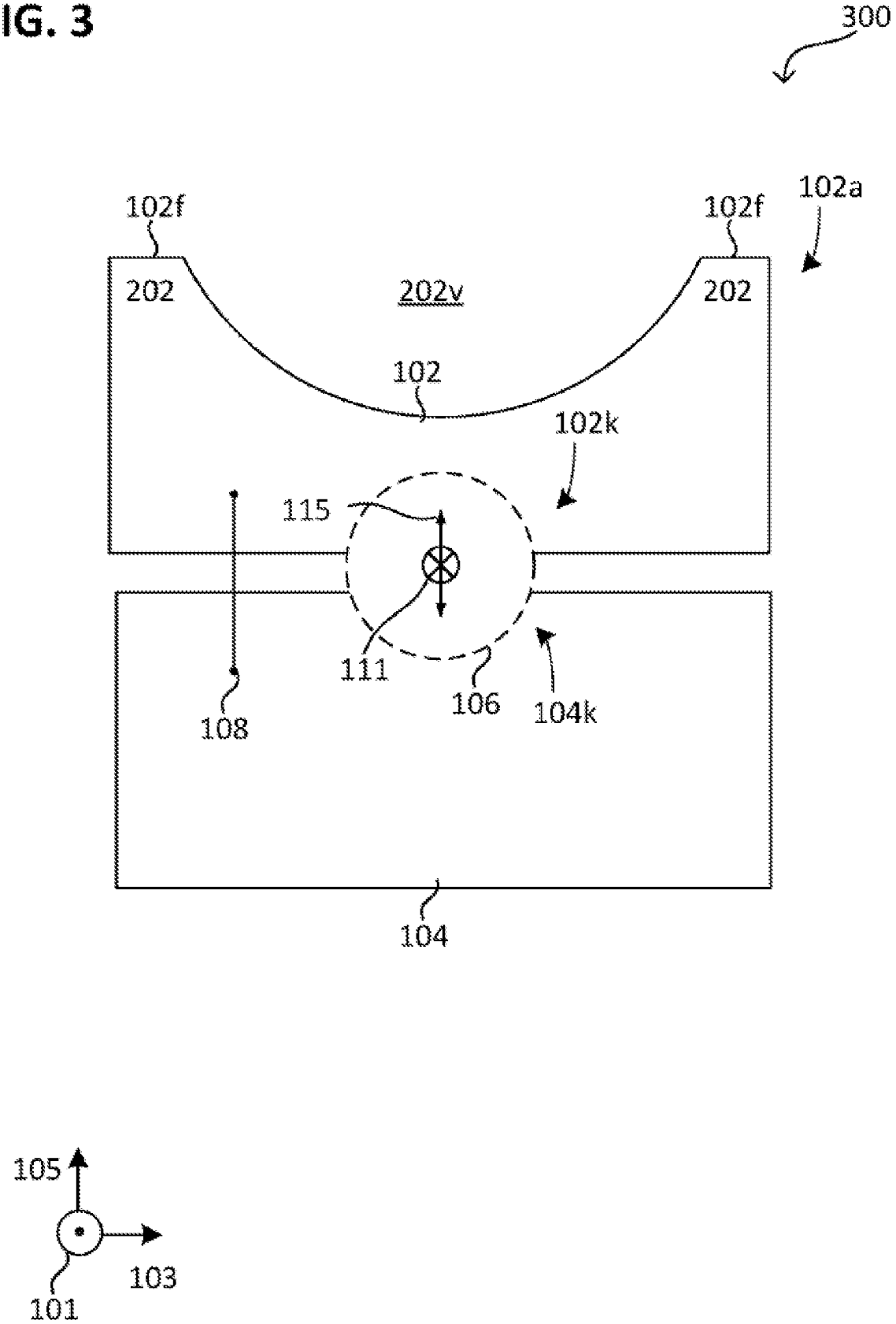

FIG. 3 shows a channel-retaining device 200 according to various embodiments 300 in a schematic side view or cross-sectional view, in which the retaining holder 102 is fork-shaped (then also referred to as a retaining fork).

The retaining fork 102, e.g. its retaining region 102*a*, can have two spatially separated sections 202 (also referred to as retaining sections 202), of which each retaining section 202 extends away from the first coupling region 102*k*. The retaining fork 102 can also have a recess 102*v*, e.g. in the retaining region 102*a*, which recess is arranged between the two retaining sections 202. The retaining fork 102, e.g. its retaining region 102*a*, can be penetrated by the recess 102*v* along direction 101.

The retaining fork 102 makes it easier to retrofit an already existing drainage system with the channel-retaining device 200. Clearly, the drainage channel, when retained by the channel-retaining device 200, can extend into the recess 102*v*.

Figure 4:
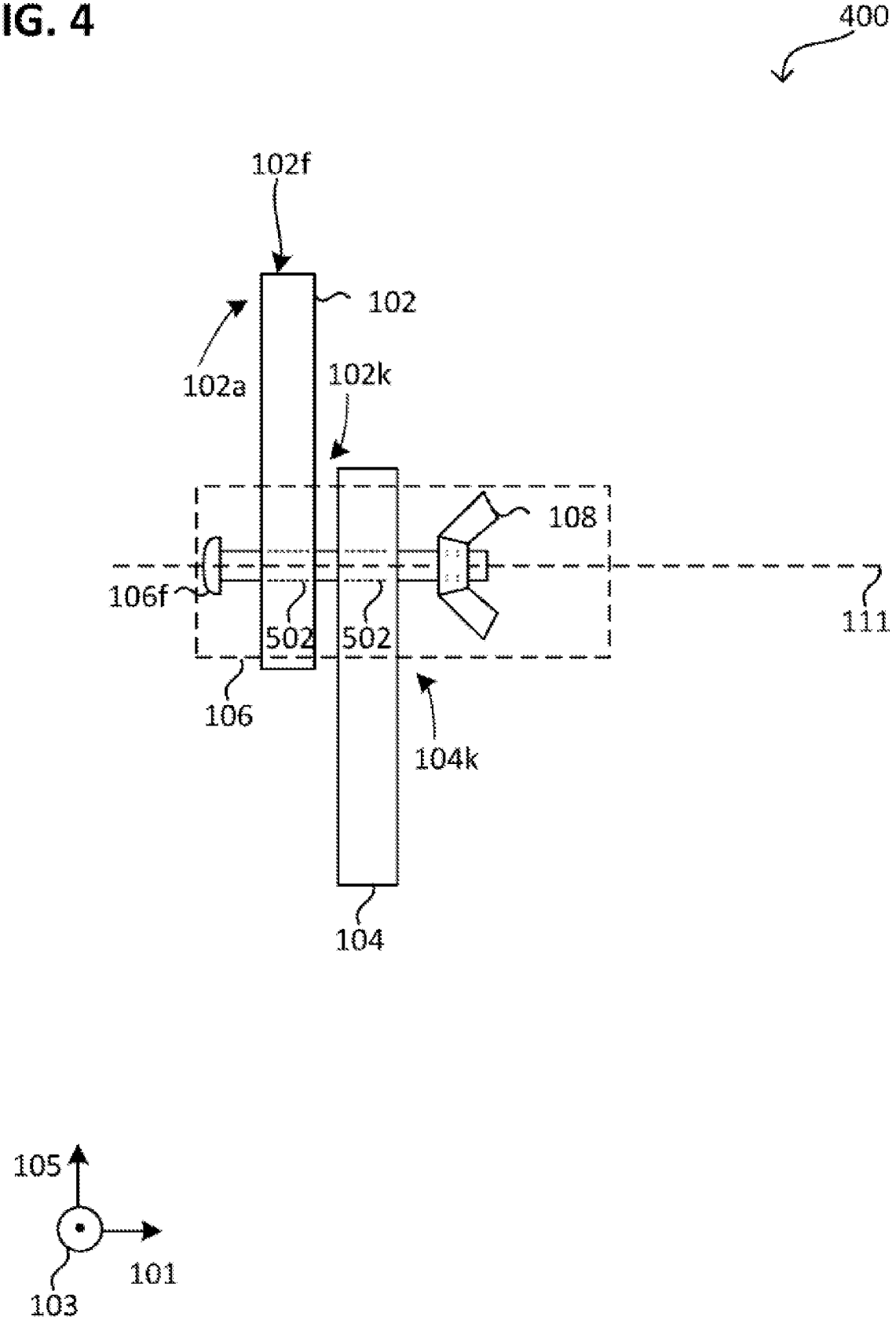

FIG. 4 shows a channel-retaining device 200 according to various embodiments 400 in a schematic side view or cross-sectional view, in which the joint 106 is joined together in a form fit by means of a coupling component 106*f*. This makes assembly easier.

The coupling component 106*f* can, for example, be a materially bonded part of one of the two coupling regions, but does not have to be. The coupling component 106*f* can, for example, also be provided as a separate component, e.g. by means of a screw, a spindle, or a rivet.

Optionally, the coupling component 106*f* can have a thread. The coupling component 106*f* can be inserted, for example, through the first coupling region 102*k* and/or through the second coupling region 104*k*.

In order to bring the locking device 108 into the first state, a force can be generated by means of the locking device 108, which force presses the two coupling regions 102*k*, 104*k* against one another. This achieves a force fit between the two coupling regions 102*k*, 104*k*, which locks them together.

Optionally, the locking device 108 can be coupled to the coupling component 106*f*. This simplifies construction and assembly. For example, the locking device 108 can have a thread which engages the thread of the coupling component 106*f*. For example, the locking device 108 can have a nut (e.g. a wing nut) which can be screwed onto the coupling component 106*f*. To bring the locking device 108 into the second state, the nut can be loosened.

In principle, the locking device 108 can also be provided separately from the joint 106. For example, the locking device 108 can have or be formed from a screw connection adjacent the joint 106.

Figure 5:
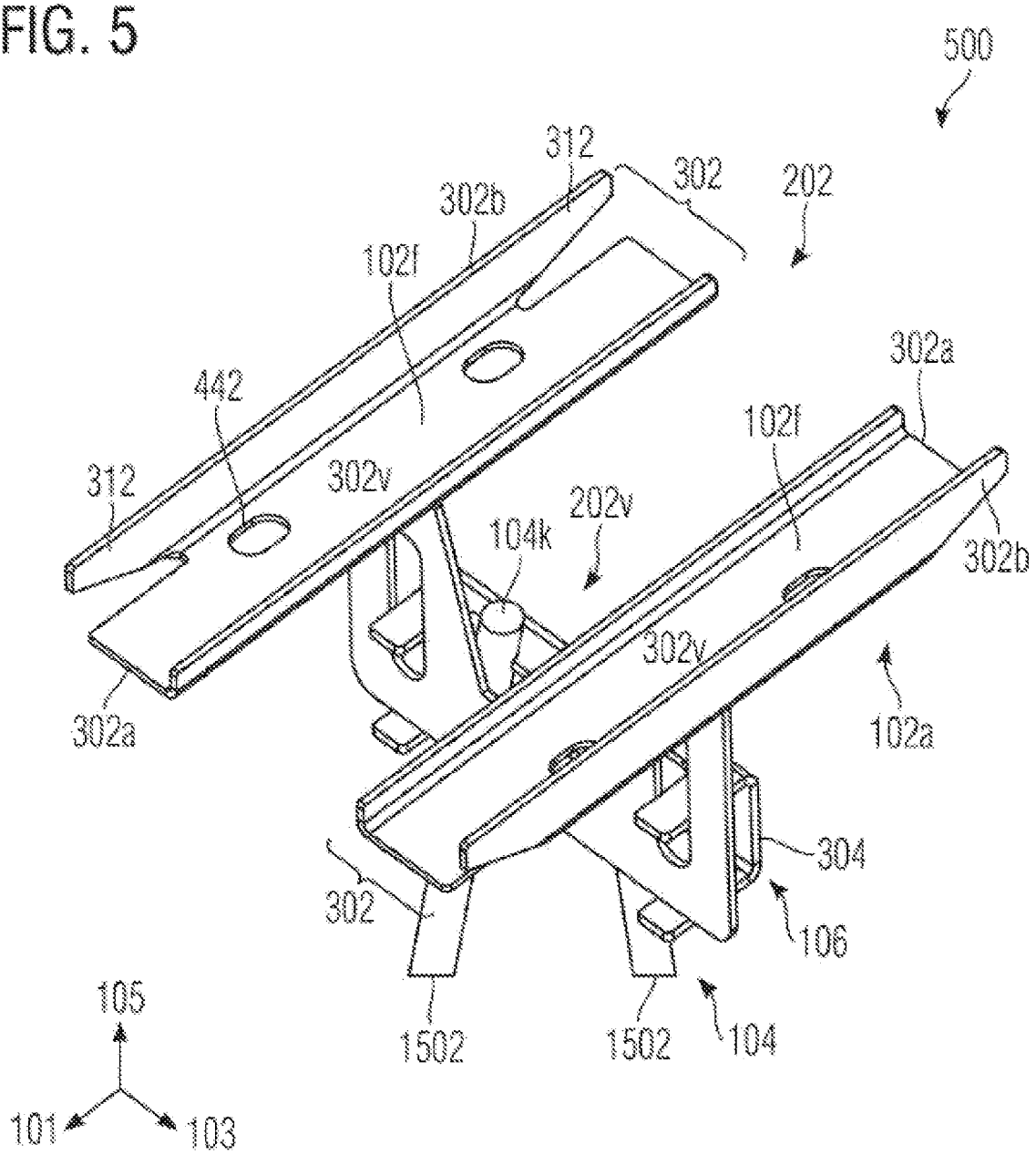

FIG. 5 shows a channel-retaining device 200 according to various embodiments 500 in a schematic perspective view, in which the retaining holder 102 has several profiled rails 302 (also referred to as profile rails). For example, each retaining section 202 can have a profile rail 302. It can be understood that the rails 302 do not necessarily need to be profiled.

A profile rail 302 can generally have a profiled surface. The profile rail 302 enables a form fit between the channel-retaining device 200 and the drainage channel or the frame and thus facilitates assembly. For example, the profile rail can have a groove 302*v* (also referred to as a holder) which is delimited by the bearing surface 102*f*.

A profile rail 302 can, for example, have several walls which are at an angle to one another and delimit the groove 302*v*. For example, a first wall 302*a* of the profile rail 302 can extend in plane 101, 103 and have the bearing surface 102*f*. For example, at least one second wall 302*b* of the profile rail 302 can extend in plane 105, 103. In the case of a non-profiled rail 302, the at least one second wall 302*b* can be omitted.

The first coupling region 102*k* may optionally include a plate-shaped section and a clamp 304 that encompasses the second coupling region 104*k* to form the coupling between the first coupling region 102*k* and the second coupling region 104*k*. However, the clamp 304 can also be part of the second coupling region 104*k* and encompass the first coupling region 102*k*. The clamp 304 can extend into openings in the plate-shaped section, which facilitates assembly.

The locking device 108 (concealed in the illustration) can optionally be configured as a clamping device, by means of which the coupling region encompassed by the clamp 304 can be clamped in order to lock the first coupling region 102*k* and the second coupling region 104*k* together. For example, the locking device 108 can be configured to transfer a force to the clamp 304, which presses the first coupling region 102*k* and the second coupling region 104*k* against one another to form the force fit. The clamping device can be part of the first coupling region 102*k* or of the second coupling region 104*k*, for example.

Optionally, the retaining region 102*a* (e.g. each of the retaining sections) can have at least one attachment structure.

As an attachment structure, the retaining region 102*a* can have a second wall 302*b*, for example, which tapers in the direction of the bearing surface 102*f* (also referred to more generally as a joining device 302*b*). This means that the second wall 302*b* has at least one freestanding section 312 (also referred to as a tab 312). By means of the or each tab 312, for example, the frame can be better attached, as will be described later in more detail.

As an attachment structure, the retaining region 102*a* can have, for example, at least one passage opening 442, so that the frame can be screwed or riveted to the retaining region 102*a*. As an attachment structure, the retaining region 102*a* can have, for example, at least one thread (not shown) into which a screw (not shown) attaching the frame can be screwed.

As illustrated, the retaining socket 104 may include at least one strut 1502, e.g. several struts. The strut 1502 may optionally (at least in the second coupling region 104*k*) be ribbed (i.e. have ribs). This improves the coupling with the first coupling region 102*k*, since the force fit causes a form fit at the same time, which blocks a degree of freedom in direction 105. The strut 1502 may be a rolled steel product, for example. For example, reinforcing steel (also referred to as rebars) can be used as a strut, which is especially inexpensive.

The several struts 1502 can be connected to one another in an articulated manner by means of the retaining holder 102 (e.g. its coupling region 102*k*) so that they form a linkage. The articulation can be eliminated by means of the locking so that the several struts 1502 are also locked relative to one another. Clearly, the linkage can be prepared easily and with few resources and then locked more easily as soon as the desired alignment has been set.

If the linkage is formed using reinforcing bars, these do not necessarily have to be supplied as they are available at most construction sites. This reduces storage costs.

In one example, the retaining socket 104 may include at least one strut 1502 which inserts into the clamp 304 from below, as shown. The strut 1502 inserted in this way extends more in direction 105 than direction 103, for example. As an alternative or in addition, the retaining socket 104 may include at least one strut 1502 (not shown) which inserts into the clamp 304 from the side. The strut 1502 inserted in this way extends more in direction 103 than direction 105, for example. In principle, however, the entire strut 1502 does not have to be straight (but it can, which increases its stability). For example, the strut 1502 (e.g. a reinforcing bar 1502) may be curved and/or angled. At least the end section (also referred to as the end-face section) of the strut 1502, which is inserted into the clamp 304 as the second coupling region 104*k*, can then be inserted into the clamp 304 from below or from the side. In other words, the strut 1502 can be extended essentially transversely to direction 101, at least on the end face or completely.

Figure 6:
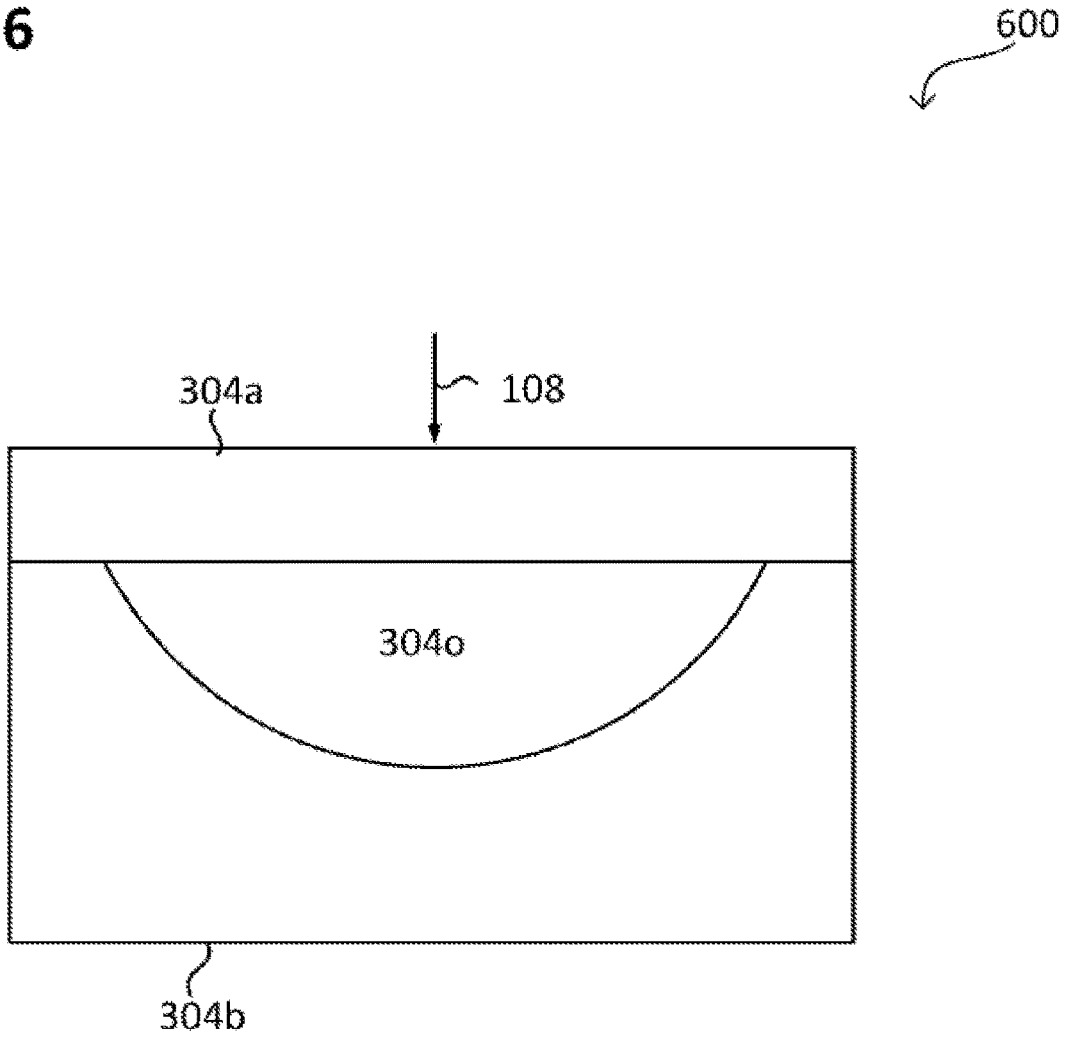
FIG. 6 shows a clamping device according to various embodiments in a schematic side view or cross-sectional view.

FIG. 6 shows a clamping device 600 according to various embodiments in a schematic side view or cross-sectional view, in which the clamping device 600 has two clamping components 304*a*, 304*b*. The two clamping components 304*a*, 304*b*, when joined together, may form an opening 304*o* (also referred to as clamp opening 304*o*) for accommodating a coupling region (e.g. the first coupling region 102*k* or the second coupling region 104*k*). The clamp opening 304*o* can be configured, for example, to accommodate at least one strut of the retaining socket 104 in the installed state, as will be described in more detail later.

The accommodated coupling region can, for example, be configured in relation to the shape and/or size of the clamp opening 304*o* such that the two clamping components 304*a*, 304*b* press against the coupling region (also referred to as clamps) accommodated in the clamp opening 304*o* when they are moved towards one another.

The locking device 108 may be configured, when placed in the first state, to impart a force on the two clamping components 304*a*, 304*b* which moves them towards one another. This means that the retaining holder 102 and the retaining socket 104 can be locked together by means of a force fit.

For example, a first clamping component 304*a* may be plate-shaped (e.g. having a plate section). For example, a second clamping component 304*b* may be clamp-shaped (e.g. provided by the clamp 304). The clamp 304 is an especially inexpensive clamping component. Other examples of clamping components 304*a*, 304*b* include: a U-bolt, a hook bolt, a clamping plate, a press connector, a quick connector.

Figure 7:
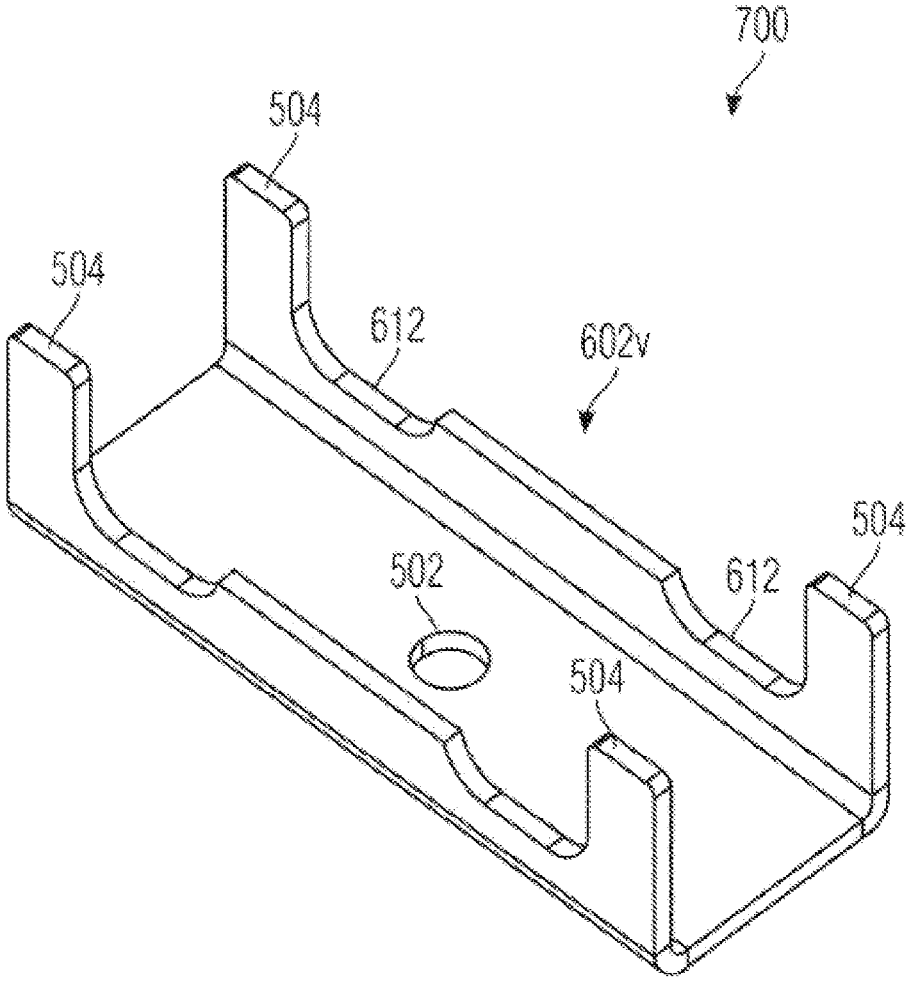
FIG. 7 shows a clamp according to various embodiments in a schematic perspective view.

FIG. 7 shows a clamp-shaped clamping plate 304*b* (e.g. provided by means of the clamp 304) according to various embodiments 700 in a schematic perspective view. The clamping plate 304*b* can, for example, have a folded plate or be formed therefrom. The clamping plate 304*b* can have at least one passage opening 502 for accommodating the coupling component 106*f*. The clamping plate 304*b* can have a depression 602*v* for forming the clamp opening 304*o*.

Optionally, the clamping plate 304*b* can have several projections 504 which engage the other clamping component 304*a*. This facilitates assembly as the interlocking components are secured against twisting.

The depression 602*v* can optionally have two tabs 612 between which the passage opening 502 is arranged. This facilitates assembly, since the struts can be inserted into the tabs 612 before locking.

Optionally, the passage opening 502 can have a thread so that it is possible to screw directly into it. This simplifies assembly.

Further exemplary implementations of the channel-retaining device 200, inter alia in connection with the drainage system 100, are explained below.

Figure 8:
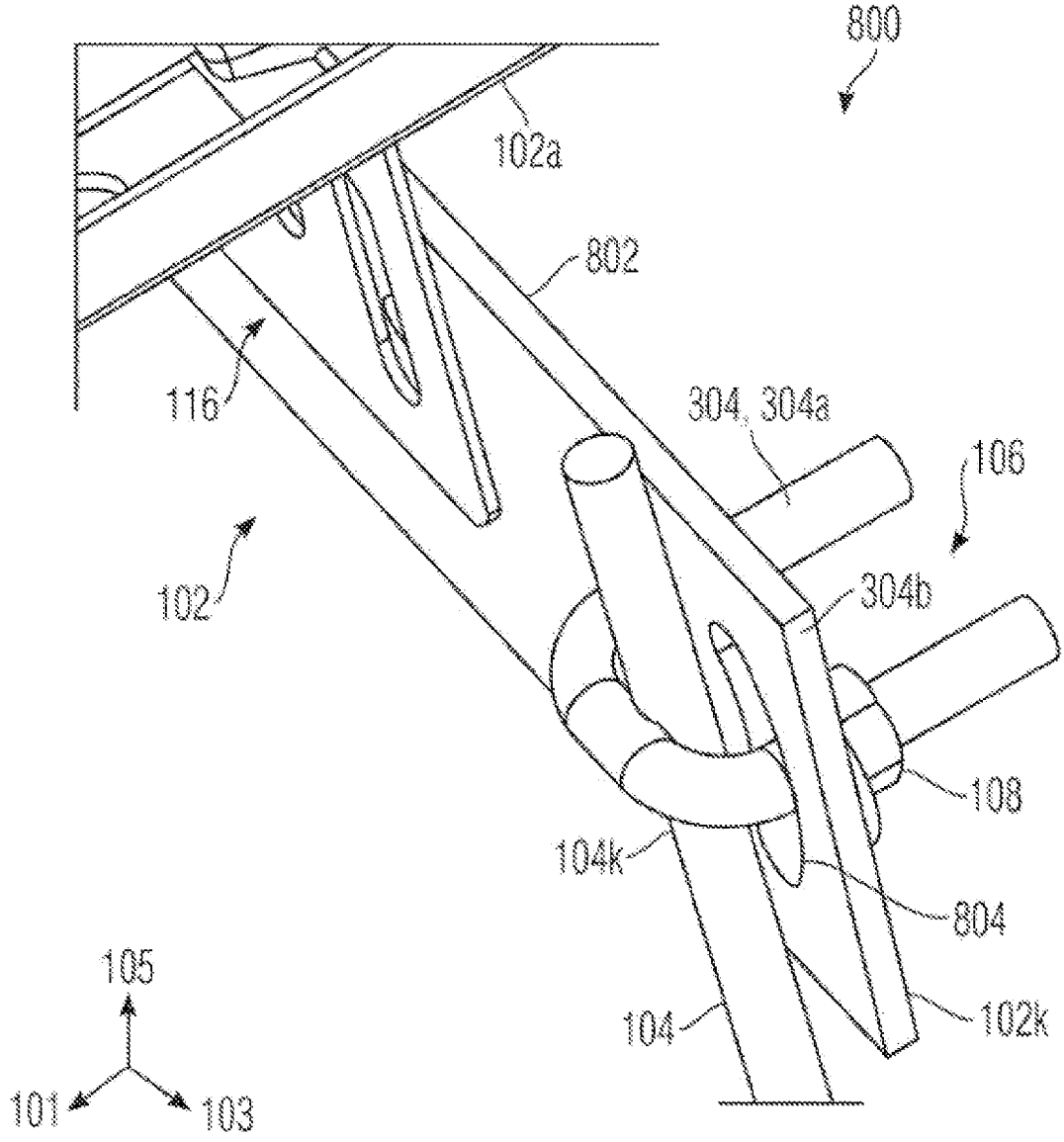

FIG. 8 shows a channel-retaining device 200 according to various embodiments 800 in a schematic perspective view, in which the retaining holder has an additional joint 116 (also referred to as a second joint 116). The second joint 116 may be separate from joint 106 (also referred to as the first joint 106). Alternatively, the functions of the second joint 116 may be integrated into the first joint 106.

The first joint 106 (e.g. a rotary joint) can provide the retaining region 102*a* and the retaining socket 104 with more degrees of rotational freedom relative to one another than the second joint 116. The second joint 116 (e.g. a sliding joint) can provide the retaining region 102*a* and the retaining socket 104 with more degrees of translational freedom relative to one another than the first joint 106.

The second joint 116 can have a parallel guide, for example, which is provided by means of two slot-shaped passage openings. This prevents tilting of joint 116.

Optionally, the channel-retaining device 200 can have an additional locking device (not shown), which is configured to be placed in a first state to block the at least one translational degree of freedom, so that the retaining region 102*a* and the retaining socket 104 are locked together, and placed in a second state to release the at least one translational degree of freedom, so that the retaining region 102*a* and the retaining socket 104 are movable relative to one another.

These separate joints 106, 116 allow the orientation and position of the retaining region 102*a* to be adjusted sequentially, which facilitates assembly. The two joints 106, 116 can be coupled to one another by means of an alignment plate 802, for example.

As shown, the first coupling region 102*k* can have an elongated hole 804 into which the clamping component 304*a* (e.g. the clamp 304) is inserted, as will be described later in more detail.

The retaining region 102*a* (also referred to as the attachment point) can optionally be formed in one piece with the inlet molding device 154 or can also be attached to it subsequently.

If the retaining region 102*a* is configured to be subsequently attached to the inlet molding device 154, the retaining region 102*a* can have the attachment structure by means of which the inlet molding device 154 can be attached, e.g. in a form fit, force fit, or material bond.

The retaining holder 102, for example its alignment plate 802, has at least one recess, holder, and/or joining device 302*b*, by means of which the retaining socket 104 (for example its alignment means) can be attached. The position of the retaining socket 104 on the alignment plate 802 can preferably be locked in an adjustable manner, for example steplessly.

The connection of the retaining socket 104 to the retaining holder 102 can, for example, have at least one screw connection (e.g. by means of a U-bolt), have at least one clamping plate, have at least one press connector, have at least one cable tie, have at least one tie wire, etc.

FIG. 9 shows a drainage system 100 according to various embodiments 900 in a schematic perspective view, in which the first coupling region 102*k* has several passage openings, e.g. a curved elongated hole 804 as the first passage opening and a round bore as the second passage opening 814. A U-bolt 304*a* can then be introduced into the several passage openings 804, 814. The U-bolt can then be rotated in a defined manner around the round bore, thus enabling an especially fine alignment of the inlet molding device 152.

As an alternative or in addition to the U-bolt 304*a*, components for joining and/or locking the retaining holder 102 to the retaining socket 104 can have: at least one hook bolt, at least one clamping plate, at least one stud bolt, at least one rivet/weld nut, at least one rivet, at least one clinching connection (also known as a clinch connection), adhesive, a combination of guide pins/tabs, and screw connections.

Figure 10:
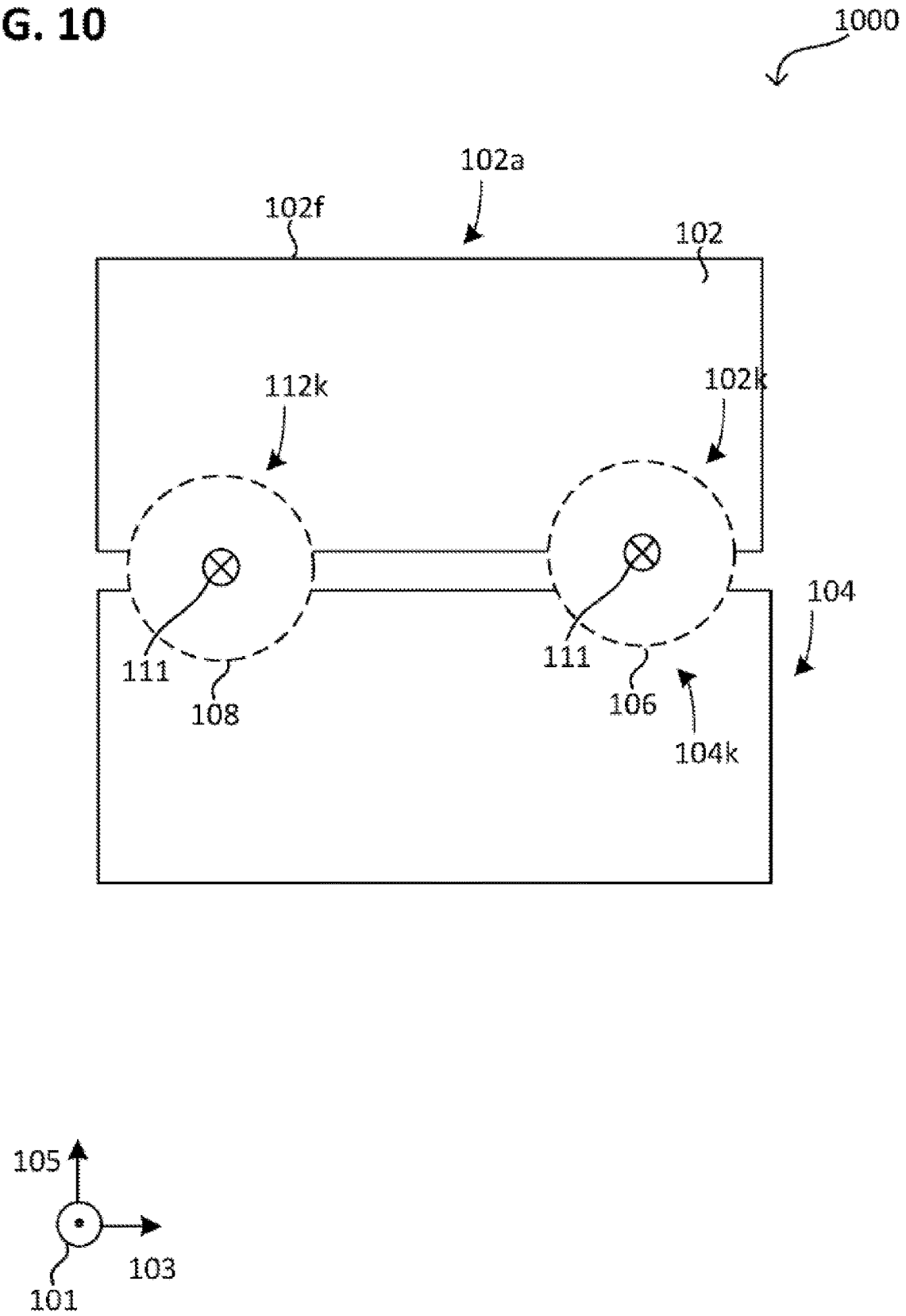

FIG. 10 shows a channel-retaining device 200 according to various embodiments 1000 in a schematic side view or cross-sectional view, in which the channel-retaining device 200 has several first coupling regions 102*k*, e.g. at least one additional first coupling region 112*k*. Each first coupling region 102*k*, 112*k* can be configured to be joined to the retaining socket 104 (its second coupling region 104*k*).

If the first coupling region 102*k* is joined to the retaining socket 104, the first joint 106 can be formed, which provides the retaining holder 102 and the retaining socket 104 with at least one rotational degree of freedom relative to one another. If the additional first coupling region 112*k* is joined to the retaining socket 104, at least one rotational degree of freedom of the joint 106 can be blocked. The locking device 108 clearly implements this by means of the additional first coupling region 112*k*.

In other words, the locking device 108 can have the additional first coupling region 112*k*. Optionally, the locking device 108 can have an additional first joint, which is configured similarly to first joint 106. For example, the additional first coupling region 112*k* can be symmetrical to first coupling region 102*k*. This means that initially the first coupling region 102*k* or initially the additional first coupling region 112*k* can be joined to the retaining socket 104 to form the first joint. This makes assembly easier.

Herein, inter alia, reference is made to a channel-retaining device 200 with only one first joint 106, wherein the description for this can apply analogously to a channel-retaining device 200 with several first joints 106, which, for example, mutually block their degrees of freedom in order to lock the channel-retaining device 200.

Optionally, the second joint 116 can be arranged between the several first coupling regions 102*k*. This improves stability.

FIG. 11 shows a hook bolt 304*a* according to various embodiments 1100 in a schematic perspective view, which achieves an especially cost-effective construction, e.g. used as an alternative or in addition to the clamp 304. The hook bolt 304*a* can serve, for example, as a coupling component 106*f* for joining the first coupling region 102*k* to the second coupling region 104*k*. The hook bolt 304*a* can serve as a clamping component for locking the channel-retaining device 200 in place, for example.

FIG. 12 shows an L-shaped clamping plate 304*b* according to various embodiments 1200 in a schematic perspective view, which achieves an especially cost-effective construction of the clamping device 600, e.g. used as an alternative or in addition to the clamp 304. The clamping plate 304*b* can serve, for example, as a clamping component for locking the channel-retaining device 200 and have several passage openings 502.

FIG. 13 shows a retaining holder 102 according to various embodiments 1300 in a schematic perspective view, in which each joining device 302*b* has several tabs 312. The joining device 302*b* can be configured to attach the inlet molding device 152 to the retaining holder 102 by means of reshaping the joining device 302*b*.

The joining device 302*b* can be designed as a separate component or be a monolithic component of the retaining holder 102. The joining device 302*b* facilitates the attachment of the retaining holder 102 to the inlet molding device 152, e.g. its frame. For attachment to the inlet molding device 152, e.g. its frame, each joining device 302*b* can have two sheet metal tabs 312, which can be bent over the leg of the frame, as shown below.

The tabs 312 enable fine adjustability of the inlet molding device 152 in a terrain, so that the surface of the inlet molding device 152 can be aligned more easily plane-parallel to the drainage surface 151. Clearly, due to the form fit that is achieved by means of the tabs 312, a translational degree of freedom is left open, according to which the retaining holder 102 can be displaced in direction 101 relative to the inlet molding device 152.

The first coupling region 102*k* can have at least one slot-shaped passage opening (e.g. an elongated hole). A clamp 304, for example, can be accommodated in this opening in order to provide a clamping device 600 and/or an anti-rotation device.

FIG. 14 shows a drainage system 100 according to various embodiments 1400 in a schematic perspective view, the tabs 312 of which are bent over the leg 1302 (a laterally protruding section) of the frame 1702. The retaining holder 102 can be attached/clamped to the frame by bending the tabs 312 at the ends of the retaining holder 102. In order to improve the clamping, the tabs can be beveled or at least tapered.

Additional examples of components of the joining device 302*b*, which are an alternative or in addition to the tabs 312, can include: screws, nuts, rivets (e.g. self-piercing press rivets). This connection of the retaining holder 102 to the inlet molding device 152 does not necessarily have to be detachable.

Optionally, the frames of the inlet molding device 152 (a cast frame) and the first coupling region 102*k* may be a single piece (from one cast), e.g. provided together as a cast product. Thus, for example, no joining device 302*b* is required.

FIG. 15 shows a drainage system 100 according to various embodiments 1500 in a schematic perspective view, the attachment structure of which has at least one passage opening 442, which achieves a form-fitting attachment of the inlet molding device 152, e.g. its frame, on the separate retaining region 102*a*. Optionally, the retaining holder 102 can be connected to two frames.

FIG. 16 shows a channel-retaining device 200 according to various embodiments 1600 in a schematic side view or cross-sectional view, the retaining socket 104 of which has several struts 1502 positioned crossed to each other. The crossed struts 1502 may provide what is known as a truss (also referred to as a rod frame or strut truss). The truss, for example its struts, can be connected at so-called nodes 1502*k*. A node 1502*k* can have the end face of a strut 1502 or be arranged between the end faces of the strut 1502, for example. The truss can have several struts 1502 which are at an angle to one another and which, for example, form a triangular truss.

In an especially simple implementation of the channel-retaining device 200, the retaining socket 104, e.g. its struts 1502, is inserted into a soft foundation concrete 1500*u* and/or attached to formwork. Optionally, e.g., after the foundation concrete 1500*u* has hardened, the struts 1502 can be bent into position and/or shortened (e.g. adjusted in length). An even simpler implementation of the channel-retaining device 200 may include struts 1502 of appropriate length being driven directly into a subgrade 1500*u*.

In the case of an especially large distance between the inlet molding device 152 and the collecting pipe 154 (also referred to as the drainage pipe), the struts 1502 can be arranged on both sides of the collecting pipe 154.

For example, the truss can be oriented along direction 101 (to stiffen the structure along its longitudinal extension) or transverse to direction 101 (to stiffen the structure across its longitudinal extension). For example, the truss can have at least one strut 1502, which extends essentially in plane 101, 105. As an alternative or in addition, the truss can have at least one strut 1502, which extends essentially in plane 103, 105. In an analogous manner, at least one strut of the truss can be extended at an angle to direction 105. The truss can optionally be supported lateral to its direction of extension by means of so-called auxiliary struts.

FIG. 17 shows a channel-retaining device 200 according to various embodiments 1700 in a schematic side view or cross-sectional view, in which the truss has several struts 1502 positioned crossed to each other. This achieves an especially stable construction. The node points 1502*k* can optionally be formed at the points where the struts 1502 cross each other. Thus, the truss can have several struts 1502 which are at an angle to one another and which, for example, form a rhombic truss. What has been described for embodiments 1600 can apply analogously to embodiments 1700. The truss can of course also have a combination of a rhombic truss and a triangular truss.

Figure 18:
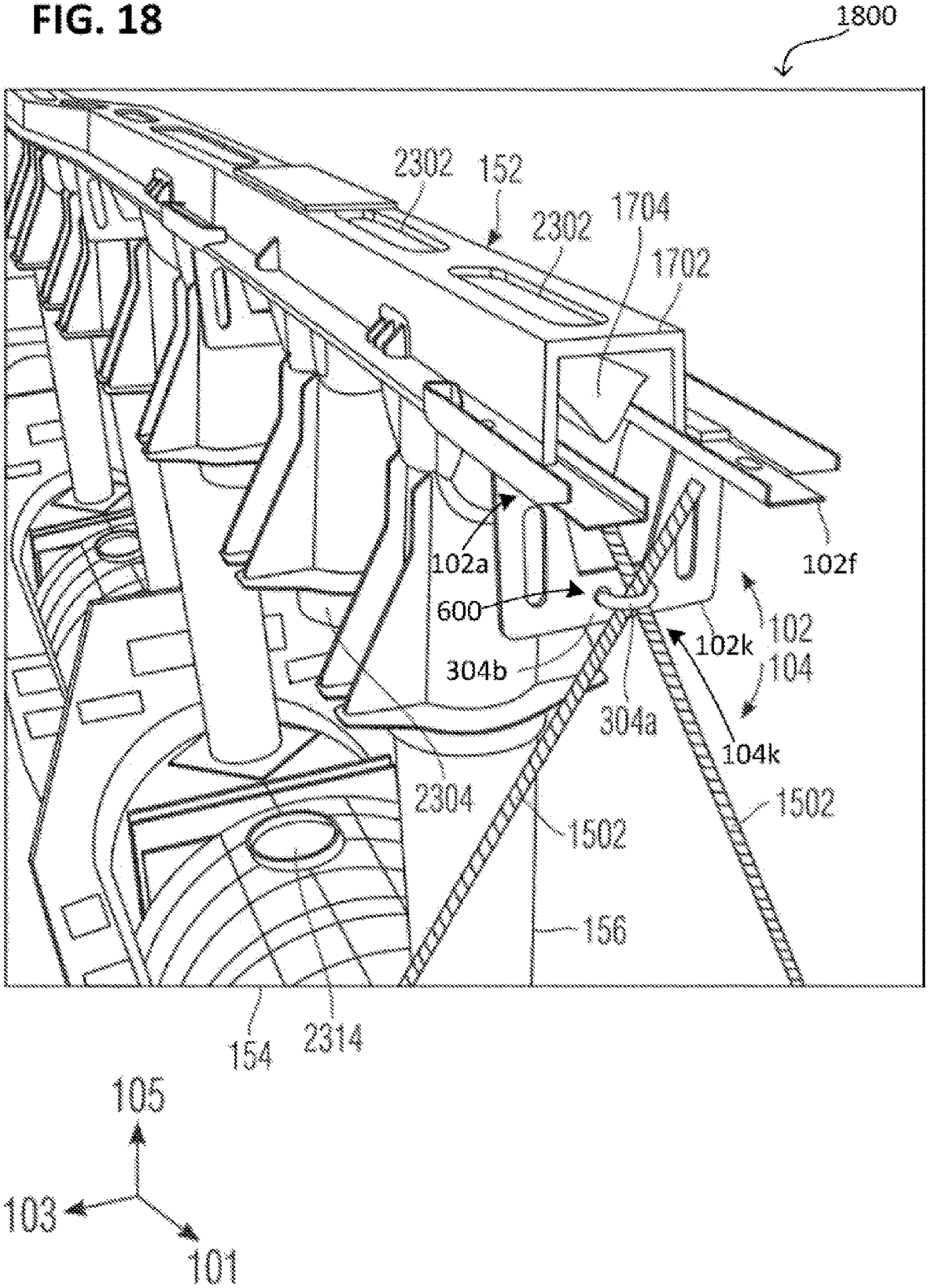

FIG. 18 shows a drainage system 100 according to various embodiments 1800 in a schematic perspective view, in which the first coupling region 102*k* has exactly one clamp-shaped first clamping component 304*a* and one plate-shaped second clamping component 304*b*, which can encompass several struts 1502 as support pillars. The several struts 1502 can, for example, be clamped and/or coupled to one another by means of the clamping component 304*b*. The frame 1702 and the drainage channel 1704 are also shown.

In more general terms, the clamping device 600 can have several components 304*a*, 304*b* which form a recess. The clamping device 600 or its recess can be configured in such a way that at least one support pillar (e.g. having one or more than one reinforcing bar 1502 and/or one or more than one plate) can be inserted into the recess. For example, the support pillar may extend essentially transversely to direction 101. For example, the support pillar may extend essentially along plane 103, 105. For example, the recess can penetrate the clamping device 600 along a direction which lies essentially in plane 103, 105, e.g. along direction 105 and/or along direction 103. Essentially, in association with an indication of direction, it can be understood as having an angular deviation from the indication of direction of less than approximately 20°, e.g. having less than approximately 10°, e.g. having less than approximately 5°.

In principle, however, the entire support pillar does not have to be extended only in one direction (but it can, which increases its stability). For example, the support pillar (e.g. its reinforcing bar 1502 and/or plate) may be curved and/or angled. At least the end section (also referred to as the end-face section) of the support pillar, which is inserted into the recess of the clamping device 600 as the second coupling region 104*k*, can then be extended essentially transversely to direction 101. In other words, the support pillar can be extended at least on the end face or completely essentially transverse to direction 1001.

In an even more stable example, the support pillar has an additional strut (also referred to as an auxiliary strut, not shown) which is coupled (e.g. welded, screwed, and/or using tie wire) to strut 1502 at a node point 1502*k* of strut 1502, which is at a distance from the first coupling region 102*k* or second coupling region 104*k*. For example, the auxiliary strut may be supported at a different location than strut 1502 to provide a truss. The auxiliary strut can be supported, for example, in subsoil, in a pipe-retaining device, and/or on formwork.

As can be seen (at the back of the picture), the drainage channel does not necessarily have to be linear (i.e. straight) but can be retained by means of one or more than one channel-retaining device 200 in such a way that it has one or more than one corrugation.

As can be seen (middle of figure), the inlet molding device 152 (e.g. its frame) does not necessarily have to have all inlet openings 2302 in open form but rather at least one inlet opening 2302 can be closed (in this case representing a cover element which covers the inlet opening).

Figure 19:
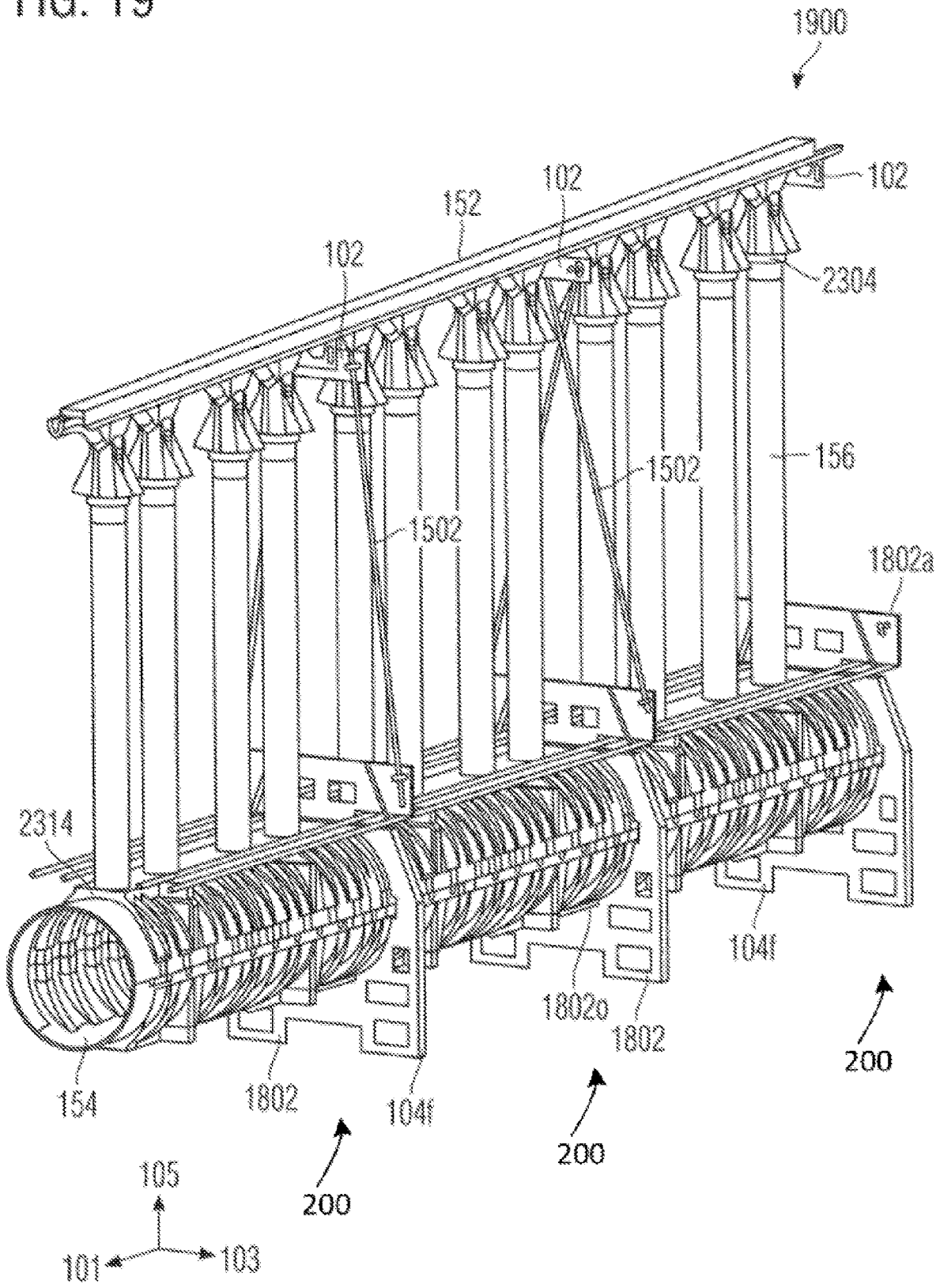

FIG. 19 shows the drainage system 100 according to various embodiments 1900 in a schematic perspective view, in which the retaining socket 104 has a pipe-retaining device 1802. The pipe-retaining device 1802 allows the struts 1502 to be attached to the pipe-retaining device 1802 as an alternative or in addition to attaching/inserting them in the ground or in concrete.

The pipe-retaining device 1802 may include a passage opening 1802*o* (also referred to as pipe-retaining opening 1802*o*) for retaining the collecting pipe 154. In principle, the pipe-retaining device 1802 can be in one piece and the collecting pipe 154, for example its pipe section, can be inserted into the pipe-retaining opening 1802*o*. This increases stability. Alternatively, the pipe-retaining device 1802 can be in several parts. The pipe-retaining device 1802 can optionally have bendable sheet metal tabs, by means of which the pipe-retaining device 1802 can be attached to the collecting pipe 154. To do this, the sheet metal tabs are bent in the direction of the collecting pipe 154.

The retaining socket 104 may optionally include an attachment structure 1802*a* (also referred to as a strut attachment structure) which couples several struts 1502 to one another and/or couples them to the pipe-retaining device 1802. Optionally, the strut attachment structure 1802*a* (e.g. a plate) may protrude laterally from the pipe-retaining device 1802 and/or be located between the pipe-retaining opening 1802*o* and the retaining holder 102. This achieves greater stability.

For example, the strut attachment structure 1802*a* may have at least one passage opening, recess, or the like to attach the struts 1502. The connection between a strut 1502 and the strut attachment structure 1802*a* can, for example, take place analogously to its attachment to the first coupling region 102*k*. Examples of optional components of the strut attachment structure include: a plate, screws, cable ties, tie wire, hook bolt, bracket.

As an alternative or in addition, the struts 1502 may be welded to a plate of the strut attachment structure 1802*a*. For example, the struts 1502 can first be welded at the bottom to the strut attachment structure 1802*a* or the pipe-retaining device 1802 and then be adjustably attached to the retaining holder 102 at the top, or in reverse order.

Optionally, a bottom section 104*f* of the retaining socket 104, e.g. its pipe-retaining device 1802, can be widened on a side opposite the second coupling region 104*k* (then also referred to as the base leg 1802). This inhibits the retaining socket 104 from sinking into soft subsoil, thus facilitating assembly. For example, the base leg 1802 can be widened in direction 101.

As shown, each retaining socket 104 can have exactly one pipe-retaining device 1802 which is coupled to the retaining holder 102 by means of at least one strut 1502. Optionally, the retaining socket 104 can have several pipe-retaining devices 1802, of which all pipe-retaining devices 1802 are coupled to the same retaining holder 102 by means of at least one strut 1502. For example, the channel-retaining device 200 may include one or more than one strut 1502 (also referred to as a main strut 1502) which couples the retaining holder 102 to a first pipe-retaining device 1802 immediately below. For example, the channel-retaining device 200 may include one or more than one additional strut (also referred to as an auxiliary strut) which couples the retaining holder 102 to a second pipe-retaining device 1802 arranged next to the first pipe-retaining device 1802.

In a similar manner, the pipe-retaining device 1802 may have several retaining holders 102 as an alternative or in addition, of which all retaining holders 102 are coupled to the same channel-retaining device 200 by means of at least one strut 1502.

In this way, a truss can clearly be formed. The auxiliary strut can, for example, be coupled directly to the retaining holder 102 and/or a pipe-retaining device 1802, e.g. through contact. Alternatively, the auxiliary strut can be coupled indirectly (e.g. by means of a strut 1502) to the retaining holder 102 and/or the pipe-retaining device 1802, so that this strut is at a distance from the retaining holder 102 or the pipe-retaining device 1802. For example, the auxiliary strut can be connected to a strut 1502 e.g. by means of tie wire.

As can be seen, the inlet molding device 152 (e.g. its frame) does not necessarily have to be open at the top, but can also be provided without inlet openings 2302 and/or can have closed inlet openings 2302.

Figure 20:
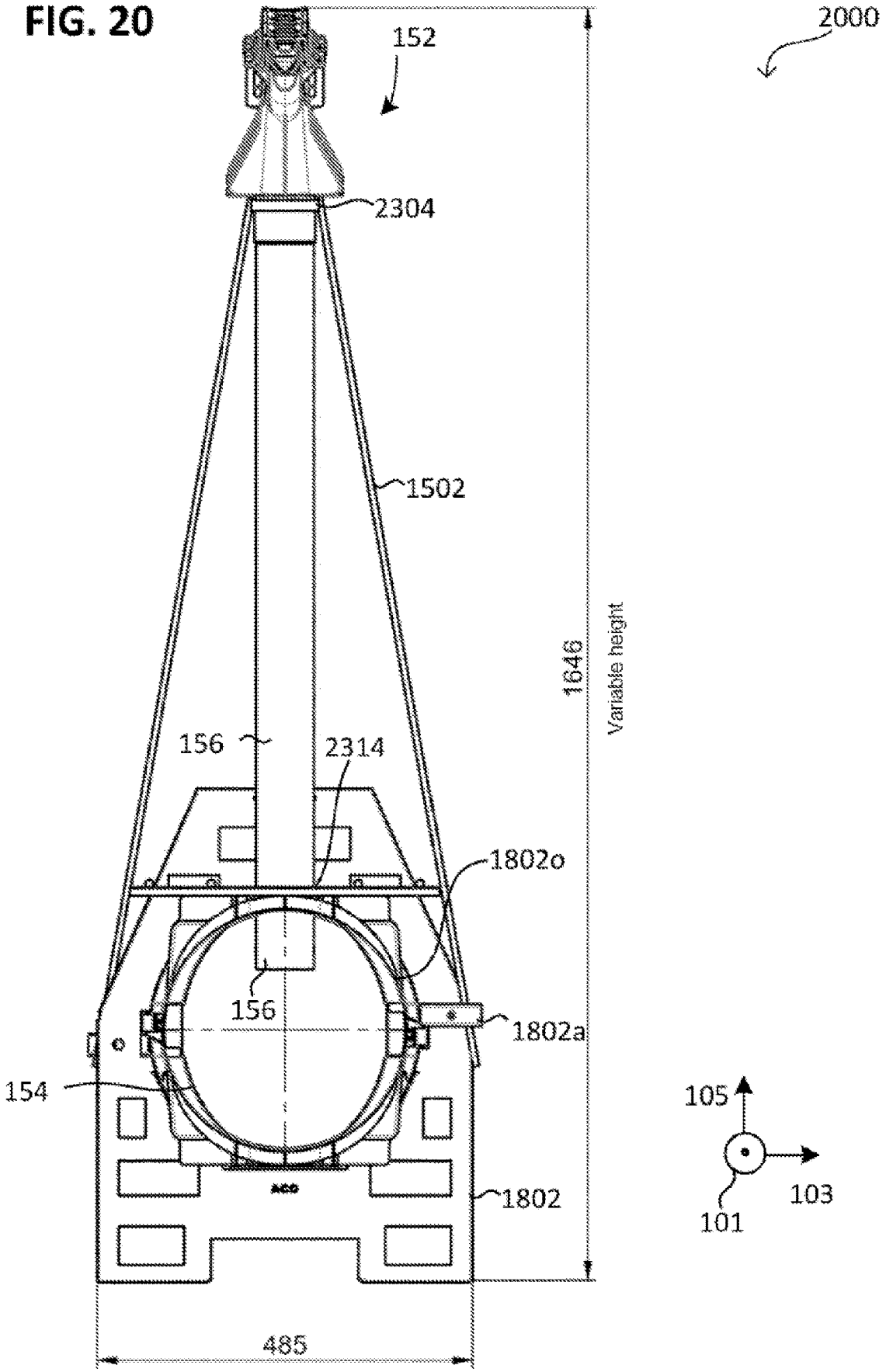

FIG. 20 shows the drainage system 100 according to various embodiments 2000 in a schematic perspective view, in which the pipe-retaining opening 1802*o* is arranged between two struts 1502. This can make assembly easier, particularly in the case of a low overall height.

FIG. 21 shows a spacer plate 2100 according to various embodiments in a schematic perspective view as an exemplary component of the retaining socket 104. For example, the retaining socket 104 can have at least one spacer plate 2100, as an alternative or in addition to struts 1502. It can be understood that what is described herein for struts 1502 may apply to spacer plates 2100 by analogy. For example, instead of a strut 1502, a spacer plate 2100 can be used, which couples the pipe-retaining device 1802 to the retaining holder 102, e.g. by screwing them together.

In the second coupling region 104*k*, the spacer plate 2100 can have at least one slot-shaped passage opening (e.g. elongated holes), which provides a translational degree of freedom. This makes it easier to adjust the height of the inlet molding device 152. As an alternative or in addition, the spacer plate 2100 can have at least one slot-shaped passage opening (e.g. elongated holes) on a side opposite the second coupling region, which provides a translational degree of freedom.

FIG. 22 shows an assembly 2200 of the drainage system 100 according to various embodiments in a schematic side view, FIG. 23 shows the assembly 2200 in a schematic sectional view A-A, and FIG. 24 shows the assembly 2200 in a schematic sectional view B-B. Several assemblies 2400 can be mounted individually and/or joined together to form the drainage system 100. For example, the assembly 2400 may have an expansion along direction 101 in a range from about 0.25 meters (e.g. 0.5 meters) to about 4 meters (e.g. 2 meters). For example, the assembly 2400 may have an expansion along direction 105 in a range from about 1 meter to about 3 meters and/or greater than the expansion along direction 101.

The frame 1702 can cover the drainage channel 1704 and encompass it on both sides. Furthermore, the frame 1702 can have several inlet openings 2302 arranged one behind the other along direction 101, of which each inlet opening 2302 optionally extends longitudinally along direction 101. This improves the water absorption rate.

Optionally, the retaining holder 102 can be connected to two frames (e.g. per assembly 2200).

The drainage channel 1704 can have several funnel-shaped depressions 1704*t* (also referred to as funnels), of which each funnel 1704*t* opens into a drop opening 2304. Each of the drop openings 2304 may be coupled to a downpipe 156. This improves the water flow.

For example, a wavy drainage surface can be drained by means of the setting options described herein, which the channel-retaining device 200 provides. As an alternative or in addition, it is also possible to form a drainage line from a plurality of assemblies 152, which extends in a meandering manner in direction 101. The drainage line can be extended incrementally according to the length of the frame (e.g. 0.5 meters, 1 meter, or 2 meters).

Figure 25:
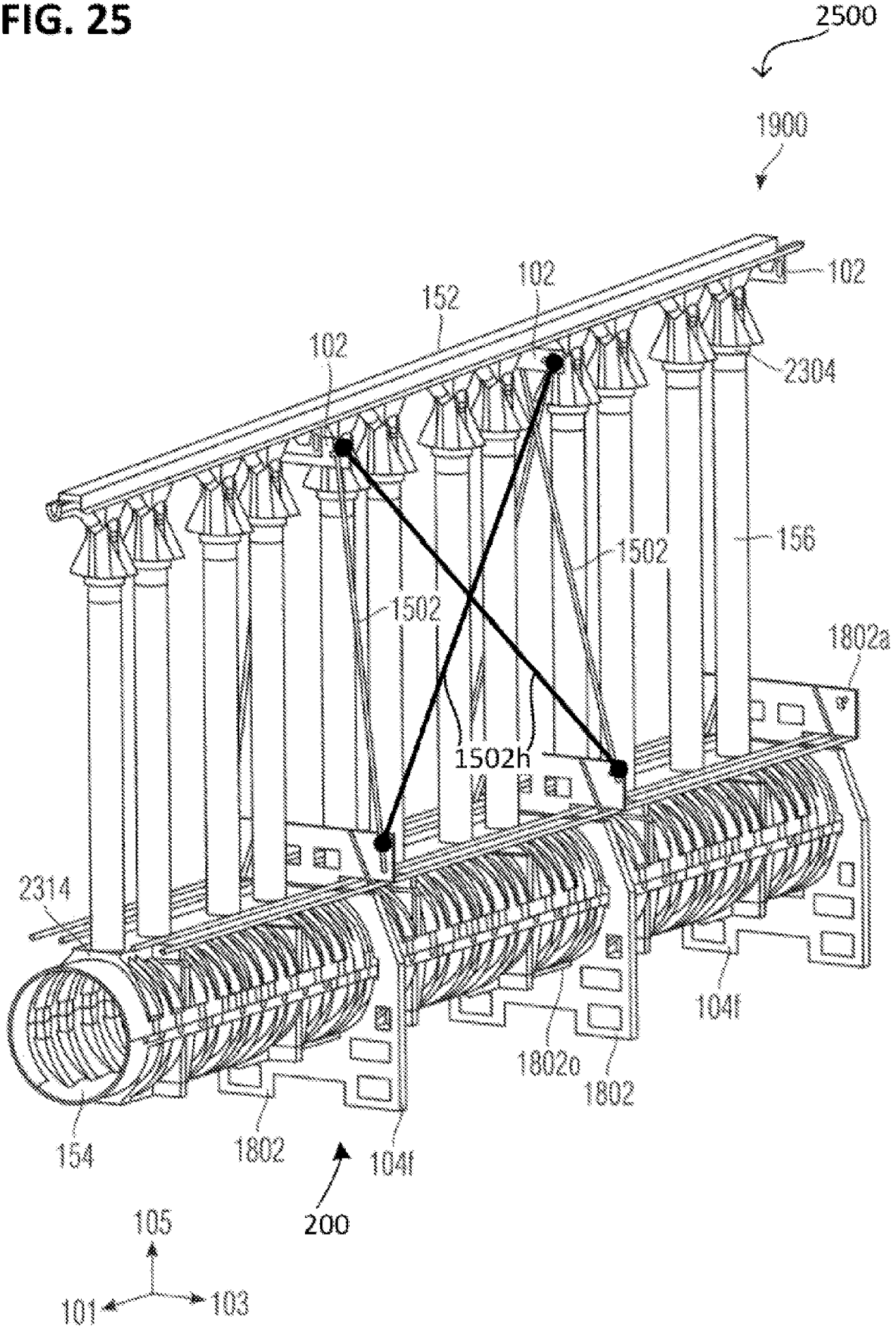

FIG. 25 shows the drainage system 100 according to various embodiments 2500 in a schematic perspective view, in which the retaining socket 104 has several pipe-retaining devices 1802, of which a first pipe-retaining device 1802 is coupled to a retaining holder 102 by means of at least one main strut 1502 and of which a second pipe-retaining device 1802 is coupled to the same retaining holder 102 by means of at least one auxiliary strut 1502*h*. As an alternative or in addition, the channel-retaining device 200 can have several retaining holders 102, of which a first retaining holder 102 is coupled to one (e.g. the first) channel-retaining device 200 by means of at least one main strut 1502 and of which a second retaining holder 102 is coupled to the same channel-retaining device 200 by means of at least one auxiliary strut 1502*h*. By analogy, the channel-retaining device 200 can also have more than two pipe-retaining devices 1802 and/or more than two retaining holders 102.

Various examples are described below which relate to those described above and shown in the figures.

Example 1 is a channel-retaining device, comprising: a retaining holder having a first coupling region and a retaining region for retaining a drainage channel extending along one direction; an optional retaining socket having a second coupling region; wherein the first coupling region and the second coupling region are configured to be joined together to form a joint which provides the retaining holder and the retaining socket with at least one rotational degree of freedom relative to one another, which is, for example, essentially along the direction, and/or at least one translational degree of freedom relative to one another, which is, for example, essentially transverse to the direction; a locking device which is configured, when placed in a first state, to block the at least one rotational degree of freedom and/or the at least one translational degree of freedom, so that the retaining holder and the retaining socket are locked together, and, when placed in a second state, to release the rotational degree of freedom, so that the retaining holder and the retaining socket are movable relative to one another.

Example 2 is a channel-retaining device, comprising: a retaining holder having a first coupling region and a retaining region for retaining a drainage channel extending along one direction; an optional retaining socket having a second coupling region; wherein the first coupling region and the second coupling region are configured to be joined together to form a joint which connects the retaining holder and the retaining socket to one another in a rotatable and/or displaceable manner, wherein an axis of rotation of the joint, for example, is essentially along the direction; a locking device which is configured, when placed in a first state, to block the rotation and/or displacement of the retaining holder and the retaining socket as relates to one another, so that they are locked together, and, when placed into a second state, to release the locking.

Example 3 is a channel-retaining device, comprising: a retaining holder which has a clamping device (e.g. having a clamp or at least a clamp-shaped plate) and a retaining region for retaining a drainage channel (e.g. extending along one direction); wherein the clamping device has a recess (e.g. penetrating the at least clamping device essentially transversely to the direction), which is configured to accommodate at least one support pillar (e.g. reinforcing bar) which (e.g. at least at the end face) is extended away from the retaining region (e.g. at least on the end face essentially transversely to the direction) and is configured (e.g. by means of the locking device), when placed in a first state, to clamp the at least one support pillar (which is optionally curved or angled) in such a way that the retaining holder and the at least one support pillar are locked together, and, when placed in a second state, to provide the at least one support pillar with a rotational degree of freedom essentially along the direction such that the retaining holder and the support pillar are connected to each other in an articulated manner or form a joint.

Example 4 is the channel-retaining device according to any one of Examples 1 to 3, wherein the retaining holder is fork-shaped (then also referred to as retaining fork); and/or wherein the retaining region has two retaining sections which are spatially separated from one another (e.g. each having a joining device); and/or wherein the retaining holder is penetrated by a recess essentially along the direction. This makes it easier to retrofit using the channel-retaining device.

Example 5 is the channel-retaining device according to any one of Examples 1 to 4, wherein the retaining socket has or is formed from a linkage, wherein the linkage has, for example, struts or rods (e.g. the reinforcing bars) which extend obliquely to one another (e.g. are crossed) (which are optionally curved or are angled), wherein the linkage is, for example, articulated when the locking device is in the second state and/or locked when the locking device is in the first state. This facilitates assembly and simplifies construction.

Example 6 is the channel-retaining device according to any one of Examples 1 to 5, wherein the retaining region (e.g. each of the retaining sections) has at least one rail. This makes it easier to retrofit using the channel-retaining device.

Example 7 is the channel-retaining device according to any one of Examples 1 to 6, wherein the retaining region (e.g. each of the retaining sections) has an attachment structure for attaching the drainage channel and/or a frame. This makes it easier to retrofit using the channel-retaining device.

Example 8 is the channel-retaining device according to any one of Examples 1 to 7, wherein the retaining region has a frame (e.g. extending essentially along the direction), e.g. a cast frame, which is, for example, a form-fitting component of the retaining region. This reduces the effort involved in assembly.

Example 9 is the channel-retaining device according to any one of Examples 1 to 8, wherein the retaining region is a cast product and/or comprises or is formed from cast steel. This improves stability.

Example 10 is the channel-retaining device according to any one of Examples 1 to 9, wherein the joint of the retaining holder and retaining socket additionally provides at least one (i.e. one or more than one) translational degree of freedom which is essentially transverse to the rotational degree of freedom. This facilitates precise assembly. The locking device may be configured to be placed in a first state to block the at least one translational degree of freedom, so that the retaining holder and the retaining socket are locked together, and, when placed in a second state, to release the at least one translational degree of freedom, so that the retaining holder and the retaining socket are movable relative to one another.

Example 11 is the channel-retaining device according to any one of Examples 1 to 10, wherein the retaining holder has an additional joint which provides the retaining region and the retaining socket with one translational degree of freedom relative to one another, wherein the joint and the additional joint, for example, are spatially separated from one another. This facilitates precise assembly.

Example 12 is the channel-retaining device according to any one of Examples 1 to 11, wherein the joint and/or the additional joint has a parallel guide for providing a translational degree of freedom. This facilitates precise assembly.

Example 13 is the channel-retaining device according to any one of Examples 1 to 12, wherein the joint and/or the additional joint is spatially separated from the retaining region.

This reduces the risk of damage to the drainage channel.

Example 14 is the channel-retaining device according to any one of Examples 1 to 13, wherein the first coupling region and the second coupling region are joined together (e.g. held together) by the locking device. This reduces the complexity of the design.

Example 15 is the channel-retaining device according to any one of Examples 1 to 14, wherein the retaining holder and the retaining socket are joined together engaging each other. This improves stability during assembly.

Example 16 is the channel-retaining device according to any one of Examples 1 to 15, wherein the retaining holder and/or the retaining socket has a plate. This reduces production costs.

Example 17 is the channel-retaining device according to any one of Examples 1 to 16, wherein the retaining socket has several crossed struts (e.g. reinforcing bars) (which are optionally curved or angled), e.g. providing a truss. This improves stability.

Example 18 is the channel-retaining device according to any one of Examples 1 to 17, further comprising: an opening formed in one retaining holder and retaining socket, and a protrusion formed in the other retaining holder and the retaining socket, wherein the protrusion engages the opening when the retaining holder and the retaining socket are joined together. This improves stability during assembly.

Example 19 is the channel-retaining device according to any one of Examples 1 to 18, wherein the retaining socket is configured to be placed upright on or inserted into the ground. This increases the application scope.

Example 20 is the channel-retaining device according to any one of Examples 1 to 19, wherein the first coupling region has several components which, when joined together, encompass and/or clamp the second coupling region, wherein the several components are secured against rotation and/or engagement, for example. This facilitates assembly.

Example 21 is the channel-retaining device according to any one of Examples 1 to 20, wherein the retaining socket has one or more than one (e.g. a one-piece or multi-piece) pipe-retaining device, of which each pipe-retaining device has a passage opening for accommodating a collecting pipe and/or of which each pipe-retaining device is coupled to the retaining holder (e.g. by means of at least one strut). This improves stability during assembly.

Example 22 is the channel-retaining device according to any one of Examples 1 to 21, wherein the retaining socket (e.g. its pipe-retaining device) has at least one (i.e. one or more than one) leg protruding along the direction. This improves stability.

Example 23 is the channel-retaining device according to any one of Examples 1 to 22, wherein the retaining socket has at least one (i.e. one or more than one) support pillar (which is optionally curved or angled) which, for example, provides the second coupling region and/or supports the retaining holder on the pipe-retaining device; wherein, for example, the or each support pillar has or is formed from a (optionally curved or angled) strut (e.g. a reinforcing bar) or a (optionally curved or angled) spacer plate. This reduces the complexity of the design.

Example 24 is the channel-retaining device according to any one of Examples 1 to 23, wherein the second coupling region (e.g. the or each support pillar) is ribbed or has a (e.g. slotted) passage opening. This simplifies assembly.

Example 25 is a drainage system (e.g. for surface drainage), comprising: a channel-retaining device according to any one of examples 1 to 24, a drainage channel which is extended essentially longitudinally along the direction and is retained by the retaining holder of the channel-retaining device, an optional frame which laterally encloses at least one segment of the drainage channel, wherein the frame has, for example, at least one longitudinal slot (e.g. longitudinal slots arranged one behind the other essentially along the direction), which is extended longitudinally essentially along the direction.

Example 26 is the drainage system according to Example 25, further comprising: at least one drop line (e.g. at least one downpipe) fluidly coupled to the drainage channel and extending away from the drainage channel (e.g. the side thereof on which the retaining holder is arranged). This increases the stability of the structure.

Example 27 is the drainage system according to Example 26, further comprising: a collecting line (e.g. a collecting pipe) which is essentially extended longitudinally along the direction (and, for example, is extended through a passage opening of the retaining socket); wherein the at least one drop line (e.g. the at least one downpipe) fluidly couples the drainage channel and the collecting line to one another; wherein, for example, a distance between the collecting line and the drainage channel is greater than an expansion of the collecting line (e.g. the downpipe) along the distance, wherein, for example, the retaining socket is supported on the collecting line (e.g. the downpipe). This increases the stability of the structure.

Example 28 is a method of assembling a drainage channel (e.g. as part of a drainage system according to any of Examples 25 to 27) using a channel-retaining device (e.g. according to any one of Examples 1 to 24), the method comprising: aligning a drainage channel which extends essentially longitudinally along the direction and is retained by means of the retaining holder of the channel-retaining device, wherein the aligning means that the retaining holder and the retaining socket are moved relative to one another according to the at least one translational degree of freedom and/or at least one rotational degree of freedom; and transitioning the locking device from the second state to the first state so that the retaining holder and the retaining socket are locked together.

Example 29 is the method according to Example 28, wherein the retaining socket is supported on or in subsoil (e.g. comprising soil or concrete) or by means of formwork (e.g. such that a weight of the drainage channel is supported by the channel-retaining device essentially in the direction of the removal of the formwork or subsoil). This increases the application scope.

Example 30 is the method according to Example 28 or 29, further comprising: embedding the drainage channel and the channel-retaining device in a material, e.g., such that the drainage channel is exposed to a surface of the material and/or is flush with the surface of the material. This increases the stability of the structure.

The invention claimed is:

1. A channel-retaining device (200), comprising:

a retaining holder (102) which has a first coupling region (102*k*) and a retaining region (102*a*) for retaining a drainage channel extending along a direction;

a retaining socket (104) which has a second coupling region (104*k*) and comprises a linkage;

wherein the first coupling region (102*k*) and the second coupling region (104*k*) are configured to be joined together to form a joint (106) which provides the retaining holder (102) and the retaining socket (104) with one rotational degree of freedom (111) relative to one another which is essentially along the direction;

a locking device (108) which is configured to be placed in a first state to block the rotational degree of freedom (111), so that the retaining holder (102) and the retaining socket (104) are locked together, and which is configured to be placed in a second state to release the rotational degree of freedom (111), so that the retaining holder (102) and the retaining socket (104) are movable relative to one another, wherein the linkage is articulated when the locking device (108) is in the second state and locked when the locking device (108) is in the first state.

2. The channel-retaining device (200) according to claim 1, wherein the retaining holder (102) is fork-shaped.

3. The channel-retaining device (200) according to claim 1, wherein the retaining region (102*a*) has an attachment structure (442, 302*b*) for attaching the drainage channel.

4. The channel-retaining device (200) according to claim 1, wherein the retaining region (102*a*) has a frame (1702) which is a form-fitting component of the retaining region (102*a*).

5. The channel-retaining device (200) according to claim 1, wherein the joint (106) of the retaining holder (102) and the retaining socket (104) additionally provides one or more than one translational degree of freedom (115) which is essentially transverse to the rotational degree of freedom (111).

6. The channel-retaining device (200) according to claim 1, wherein the first coupling region (102*k*) and the second coupling region (104*k*) are joined together by means of the locking device (108).

7. The channel-retaining device (200) according to claim 1, wherein the retaining holder (102) and/or the retaining socket (104) has a plate.

8. The channel-retaining device (200) according to claim 1, wherein the first coupling region (102*k*) has several components (304*a*, 304*b*, 304) which, when joined together, encompass and/or clamp the second coupling region (104*k*).

9. The channel-retaining device (200) according to claim 8, wherein the several components are secured against rotation and/or engage with each other.

10. The channel-retaining device (200) according to claim 1, wherein the retaining socket (104) has one or more than one pipe-retaining device (1802) which has a passage opening for accommodating a collecting pipe (154).

11. The channel-retaining device (200) according to claim 10, wherein the retaining socket (104) has one or more than one support pillar (1502, 2100) which supports the retaining holder (102) on the one or more than one pipe-retaining device (1502).

12. The channel-retaining device (200) according to claim 1, wherein the second coupling region (104*k*) is ribbed or has a slotted passage opening.

13. A drainage system (100), comprising:

a channel-retaining device (200) according to claim 1;

a drainage channel (1704) which is extended longitudinally along the direction (101) and retained by the retaining holder (102) of the channel-retaining device (200).

14. The drainage system (100) according to claim 13, further comprising:

at least one drop line (156) which is fluidly coupled to the drainage channel (1704) and extends away from the drainage channel (1704).

15. The drainage system (100) according to claim 14, further comprising:

a collecting line (154) which is longitudinally extended along the direction (101);

wherein the at least one drop line (156) fluidly couples the drainage channel (1704) and the collecting line (154) to one another.

16. A method for assembling a drainage channel (1704) by means of a channel-retaining device (200) according to claim 1, the method comprising:

aligning the drainage channel (1704) which is extended longitudinally along the direction and is retained by means of the retaining holder (102) of the channel-retaining device (200), wherein the aligning means that the retaining holder (102) and the retaining socket (104) are moved relative to each other according to the rotational degree of freedom (111);

transitioning the locking device (108) from the second state into the first state so that the retaining holder (102) and the retaining socket (104) are locked together.

17. The method according to claim 16, wherein the retaining socket (104) is supported on or in subsoil or by means of formwork.

* * * * *